US012790714B2

(12) United States Patent
Wang et al.

(10) Patent No.: US 12,790,714 B2
(45) Date of Patent: Nov. 10, 2026

(54) ELECTROPLATING APPARATUS AND ELECTROPLATING METHOD

(71) Applicant: ACM RESEARCH (SHANGHAI), INC., Shanghai (CN)

(72) Inventors: Hui Wang, Shanghai (CN); Jian Wang, Shanghai (CN); Zhaowei Jia, Shanghai (CN); Hongchao Yang, Shanghai (CN); Jun Cai, Shanghai (CN); Chenhua Lu, Shanghai (CN); Jiaqi Li, Shanghai (CN); Meng Wu, Shanghai (CN)

(73) Assignee: ACM RESEARCH (SHANGHAI), INC., Shanghai (CN)

( * ) Notice: Subject to any disclaimer, the term of this patent is extended or adjusted under 35 U.S.C. 154(b) by 621 days.

(21) Appl. No.: 18/264,378

(22) PCT Filed: Dec. 13, 2021

(86) PCT No.: PCT/CN2021/137466

§ 371 (c)(1),
(2) Date: Aug. 4, 2023

(87) PCT Pub. No.: WO2022/166406

PCT Pub. Date: Aug. 11, 2022

(65) Prior Publication Data

US 2024/0044038 A1 Feb. 8, 2024

(30) Foreign Application Priority Data

Feb. 4, 2021 (CN) ..... 202110154928.5

(51) Int. Cl.

| | |
|---|---|
| ***C25D 21/10*** | (2006.01) |
| ***C25D 7/12*** | (2006.01) |
| ***C25D 17/00*** | (2006.01) |

(52) U.S. Cl.

CPC ..... *C25D 21/10* (2013.01); *C25D 7/12* (2013.01); *C25D 17/001* (2013.01)

(58) Field of Classification Search

None

See application file for complete search history.

(56) References Cited

U.S. PATENT DOCUMENTS

| | | | |
|---|---|---|---|
| 6,379,511 | B1 | 4/2002 | Fatula et al. |
| 2004/0055876 | A1 | 3/2004 | Browne et al. |

(Continued)

FOREIGN PATENT DOCUMENTS

| | | | |
|---|---|---|---|
| CN | 101451264 | A | 6/2009 |
| CN | 103250258 | A | 8/2013 |

(Continued)

OTHER PUBLICATIONS

International Search Report issued in International Application No. PCT/CN2021/137466 dated Mar. 14, 2022 (4 pages).

(Continued)

*Primary Examiner* — Louis J Rufo

(74) *Attorney, Agent, or Firm* — Osha Bergman Watanabe & Burton LLP

(57) ABSTRACT

Disclosed in one embodiment of the present invention is an electroplating apparatus and an electroplating method. The electroplating apparatus comprises a plurality of paddles arranged in parallel. The paddles move in a direction parallel to a substrate, and are used to stir electroplating solution. Within one cycle, the paddles perform reciprocating motion at a set stroke, and the turning points of the reciprocating motion are related to the width of the paddles and the narrowest width of a gap between adjacent paddles. According to the present invention, by designing the size and movement mode of the paddles, the accumulated time in which each corresponding point on the substrate is blocked (Continued)

by the paddles is equal, so that the received quantity of electricity is equal, and thus the consistency of an electroplating height is further improved.

14 Claims, 20 Drawing Sheets

(56) References Cited

U.S. PATENT DOCUMENTS

| | | | | |
|---|---|---|---|---|
| 2004/0256219 | A1* | 12/2004 | Heller | C25D 17/06 204/213 |
| 2005/0006241 | A1* | 1/2005 | McHugh | C25D 17/008 205/80 |
| 2013/0334051 | A1 | 12/2013 | Chen et al. | |
| 2015/0368825 | A1 | 12/2015 | Mine | |
| 2021/0102295 | A1* | 4/2021 | Okuda | C25D 17/02 |

FOREIGN PATENT DOCUMENTS

| | | | | |
|---|---|---|---|---|
| CN | 107017169 | A | 8/2017 | |
| CN | 108396364 | A | 8/2018 | |
| CN | 109652851 | A | 4/2019 | |
| CN | 109722704 | A | 5/2019 | |
| CN | 110219038 | A | 9/2019 | |
| CN | 110629263 | A | 12/2019 | |
| JP | S61177392 | A | 8/1986 | |
| JP | 09273000 | A | 10/1997 | |
| JP | 2014185375 | A | 10/2014 | |
| JP | 2019151874 | A | 9/2019 | |
| KR | 20060024792 | A | 3/2006 | |
| TW | 202035802 | A | 10/2020 | |
| WO | WO-2019041154 | A1 * | 3/2019 | C25D 21/10 |

OTHER PUBLICATIONS

Written Opinion issued in International Application No. PCT/CN2021/137466 dated Mar. 14, 2022 (3 pages).

Office Action issued in Taiwanese Application No. 110147600, mailed on Jul. 24, 2025 (6 pages).

Office Action issued in Japanese Application No. 2023-547417, mailed on Sep. 24, 2025 (2 pages).

Office Action issued in corresponding KR Application No. 10-2023-7029986 dated Mar. 25, 2026 (9 pages).

Office Action issued in corresponding SG Application No. 11202305905Q dated Feb. 12, 2026 (10 pages).

* cited by examiner

ELECTROPLATING APPARATUS AND ELECTROPLATING METHOD

FIELD OF THE INVENTION

The present invention relates to the field of semiconductor devices, and in particular, to an electroplating apparatus and an electroplating method.

BACKGROUND

Electroplating is the primary process for completing copper interconnections. Currently, there are two types of electroplating apparatus on the market: horizontal jet cup plating and vertical rack plating. Vertical rack plating is to immerse substrates vertically in the plating solution, and one plating tank can perform multiple substrates plating at the same time. Cup plating is to cover a substrate in a cup-shaped plating tank, and plating is performed one cup per substrate. Compared with rack plating, the process of cup plating is more controllable and can meet more complex and diverse product requirements.

With the development of technology, the chip area increases, and the number of bumps in the chip increases sharply. There may even be tens of thousands or even more than 100,000 of bumps inside a single chip. The electroplating process requires higher electroplating rate and output, and in the field of advanced packaging, higher uniformity inside the chip is also required. However, it is difficult to achieve uniformity inside the chip, that is, the coplanarity of the bumps, in the case of weak stirring. At the same time, for the advanced packaging technology of interconnections between chips, the height of copper pillars can reach 250 um, which puts higher requirements on the mass transfer during the electroplating process. Ordinary stirring has weak mass transfer and cannot meet the requirements of production capacity and quality.

To enhance the stirring of electroplating solution, a paddle assembly can be installed in the electroplating apparatus, which includes multiple paddles parallel to the substrate surface. The paddles reciprocate to stir the electroplating solution, fully supplying metal ions and electroplating additives to the substrate surface. However, in practice, during the stirring process of ordinary paddles, there is no control over the time while the surface of the substrate is blocked by the paddles. As a result, quantity of electricity received by each point on the surface of the substrate is uneven, and there still exists the problem of uneven electroplating height.

SUMMARY

The present invention aims to provide an electroplating apparatus and an electroplating method in view of the above technical problems, so as to improve the consistency of electroplating height on the substrate.

To achieve the objective, an embodiment of the present invention proposes an electroplating apparatus comprising multiple parallel paddles, the paddles being arranged in parallel to the substrate to stir the electroplating solution. The electroplating apparatus further comprises a controller and a driving mechanism. The driving mechanism is connected to the controller and the paddles respectively, and the controller controls the driving mechanism to make the paddles move periodically so that each corresponding point on the substrate accumulated time blocked by the paddles is equal;

Taking the arrangement direction of the paddles as the coordinate axis direction, the movement steps of the paddles within one cycle comprising:

moving right from the coordinate origin to coordinate Δ;
moving left to coordinate c;
moving right to coordinate Δ+c;
moving left to coordinate 2c;
. . .
moving right to coordinate Δ+(N−1)*c;
moving left to coordinate N*c;
moving right to coordinate Δ+N*c;
moving left back to the coordinate origin;

Wherein, Δ≥a+b, a is the width of the paddle, b is the narrowest width between adjacent paddles, $$c = \begin{cases} a, & a < b \\ b, & a \geq b \end{cases}, \; b = N * a \text{ or } a = N * b,$$

N is an integer.

Another embodiment of the present invention proposes an electroplating apparatus comprising multiple parallel paddles, the paddles being arranged in parallel to the substrate to stir the electroplating solution. The electroplating apparatus further comprises a controller and a driving mechanism. The driving mechanism is connected to the controller and the paddles respectively, and the controller controls the driving mechanism to make the paddles move periodically so that each corresponding point on the substrate accumulated time blocked by the paddles is equal;

Taking the arrangement direction of the paddles as the coordinate axis direction, the movement steps of the paddles within one cycle comprising:

moving left to coordinate c;
moving right to coordinate Δ+c;
moving left to coordinate 2c;
. . .
moving right to coordinate Δ+(N−1)*c;
moving left to coordinate N*c;
moving right to coordinate Δ+N*c;
moving left to coordinate N*c;
moving right to coordinate Δ+(N−1)*c;
. . .
moving left to coordinate 2c;
moving right to coordinate Δ+c
moving left to coordinate c;
moving right to coordinate Δ;
moving left back to the origin;
moving right to coordinate Δ+N*c;
moving left back to the origin;

Wherein, Δ≥a+b, a is the width of the paddle, b is the narrowest width between adjacent paddles, $$c = \begin{cases} a, & a < b \\ b, & a \geq b \end{cases}, \; b = N * a \text{ or } a = N * b,$$

N is an integer.

Another embodiment of the present invention proposes an electroplating apparatus comprising multiple parallel paddles, the paddles being arranged in parallel to the substrate to stir the electroplating solution. The electroplating apparatus further comprises a controller and a driving mechanism. The driving mechanism is connected to the controller and the paddles respectively, and the controller controls the driving mechanism to make the paddles move periodically so that each corresponding point on the substrate accumulated time blocked by the paddles is equal;

Taking the arrangement direction of the paddles as the coordinate axis direction, the movement steps of the paddles within one cycle comprising:

moving right from the origin to coordinate Δ;
moving left to coordinate c;
moving right to coordinate Δ+c;
moving left to coordinate 2c;
moving right to coordinate Δ+(y−2)*c;
moving left to coordinate (y−1)*c;
moving right to coordinate Δ+(y−1)*c;
moving left back to the origin;

Wherein, Δ≥a+b, a is the width of the paddle, b is the narrowest width between adjacent paddles, $$c = \begin{cases} a, & a < b \\ b, & a \geq b \end{cases}, y = x*(N+1), b = N*a \text{ or } a = N*b,$$

N is a non-integer greater than 1, and x is a value that makes x*N be an integer.

Another embodiment of the present invention proposes an electroplating apparatus comprising multiple parallel paddles, the paddles being arranged in parallel to the substrate to stir the electroplating solution. The electroplating apparatus further comprises a controller and a driving mechanism. The driving mechanism is connected to the controller and the paddles respectively, and the controller controls the driving mechanism to make the paddles move periodically so that each corresponding point on the substrate accumulated time blocked by the paddles is equal;

Taking the arrangement direction of the paddles as the coordinate axis direction, the movement steps of the paddles within one cycle comprising:

moving right from the origin to coordinate Δ;
moving left to coordinate c;
moving right to coordinate Δ+c;
moving left to coordinate 2c;
. . .
moving right to coordinate Δ+(y−2)*c;
moving left to coordinate (y−1)*c;
moving right to coordinate Δ+(y−1)*c;
moving left to coordinate (y−1)*c;
moving right to coordinate Δ+(y−2)*c;
. . .
moving left to coordinate 2c;
moving right to coordinate Δ+c;
moving left to coordinate c;
moving right to coordinate Δ;
moving left back to the origin;
moving right to coordinate Δ+(y−1)*c;
moving left back to the origin;

Wherein, Δ≥a+b, a is the width of the paddle, b is the narrowest width between adjacent paddles, $$c = \begin{cases} a, & a < b \\ b, & a \geq b \end{cases}, y = x*(N+1), b = N*a \text{ or } a = N*b,$$

N is a non-integer greater than 1, and x is a value that makes x*N be an integer.

One embodiment of the present invention proposes an electroplating method comprising setting multiple parallel paddles, the paddles being arranged parallel to the substrate and moving to stir the electroplating solution, and controlling the paddles movement so that each corresponding point on the substrate accumulated time blocked by the paddles is equal;

Taking the arrangement direction of the paddles as the coordinate axis direction, the movement steps of the paddles within one cycle comprising:

moving right from the coordinate origin to coordinate Δ;
moving left to coordinate c;
moving right to coordinate Δ+c;
moving left to coordinate 2c;
. . .
moving right to coordinate Δ+(N−1)*c;
moving left to coordinate N*c;
moving right to coordinate Δ+N*c;
moving left back to the coordinate origin;

Wherein, Δ≥a+b, a is the width of the paddle, b is the narrowest width between adjacent paddles, $$c = \begin{cases} a, & a < b \\ b, & a \geq b \end{cases}, b = N*a \text{ or } a = N*b,$$

N is an integer.

Another embodiment of the present invention proposes an electroplating method comprising setting multiple parallel paddles, the paddles being arranged parallel to the substrate and moving to stir the electroplating solution, and controlling the paddles movement so that each corresponding point on the substrate accumulated time blocked by the paddles is equal;

Taking the arrangement direction of the paddles as the coordinate axis direction, the movement steps of the paddles within one cycle comprising:

moving left to coordinate c;
moving right to coordinate Δ+c;
moving left to coordinate 2c;
. . .
moving right to coordinate Δ+(N−1)*c;
moving left to coordinate N*c;
moving right to coordinate Δ+N*c;
moving left to coordinate N*c;
moving right to coordinate Δ+(N−1)*c;
. . .
moving left to coordinate 2c;
moving right to coordinate Δ+c
moving left to coordinate c;
moving right to coordinate Δ;
moving left back to the origin;
moving right to coordinate Δ+N*c;
moving left back to the origin;

Wherein, Δ≥a+b, a is the width of the paddle, b is the narrowest width between adjacent paddles, $$c = \begin{cases} a, & a < b \\ b, & a \geq b \end{cases}, b = N*a \text{ or } a = N*b,$$

N is an integer.

Another embodiment of the present invention proposes an electroplating method comprising setting multiple parallel paddles, the paddles being arranged parallel to the substrate and moving to stir the electroplating solution, and controlling the paddles movement so that each corresponding point on the substrate accumulated time blocked by the paddles is equal;

Taking the arrangement direction of the paddles as the coordinate axis direction, the movement steps of the paddles within one cycle comprising:

moving right from the origin to coordinate Δ;
moving left to coordinate c;
moving right to coordinate Δ+c;
moving left to coordinate 2c;
. . .
moving right to coordinate Δ+(y−2)*c;
moving left to coordinate (y−1)*c;
moving right to coordinate Δ+(y−1)*c;
moving left back to the origin;

Wherein, Δ≥a+b, a is the width of the paddle, b is the narrowest width between adjacent paddles, $$c = \begin{cases} a, & a < b \\ b, & a \geq b \end{cases}, y = x*(N+1), b = N*a \text{ or } a = N*b,$$

N is a non-integer greater than 1, and x is a value that makes x*N be an integer.

Another embodiment of the present invention proposes an electroplating method comprising setting multiple parallel paddles, the paddles being arranged parallel to the substrate and moving to stir the electroplating solution, and controlling the paddles movement so that each corresponding point on the substrate accumulated time blocked by the paddles is equal;

Taking the arrangement direction of the paddles as the coordinate axis direction, the movement steps of the paddles within one cycle comprising:

moving right from the origin to coordinate Δ;
moving left to coordinate c;
moving right to coordinate Δ+c;
moving left to coordinate 2c;
. . .
moving right to coordinate Δ+(y−2)*c;
moving left to coordinate (y−1)*c;
moving right to coordinate Δ+(y−1)*c;
moving left to coordinate (y−1)*c;
moving right to coordinate Δ+(y−2)*c;
. . .
moving left to coordinate 2c;
moving right to coordinate Δ+c;
moving left to coordinate c;
moving right to coordinate Δ;
moving left back to the origin;
moving right to coordinate Δ+(y−1)*c;
moving left back to the origin;

Wherein, Δ≥a+b, a is the width of the paddle, b is the narrowest width between adjacent paddles, $$c = \begin{cases} a, & a < b \\ b, & a \geq b \end{cases}, y = x*(N+1), b = N*a \text{ or } a = N*b,$$

N is a non-integer greater than 1, and x is a value that makes x*N be an integer.

The present invention improves the consistency of electroplating height by designing the movement mode of the paddle, which blocks each corresponding point on the substrate for an equal amount of time and receives an equal amount of quantity of electricity.

DETAILED DESCRIPTION

To provide a detailed description of the technical content, structural features, achieved objectives and effects of the present invention, the following will be described in detail with reference to embodiments and accompanying diagrams.

In an electroplating apparatus, in order to enhance the agitation of the electroplating solution, a paddle can be installed in a position opposite to the substrate. During electroplating, the paddle reciprocates along a direction parallel to the substrate to enhance the agitation of the electroplating solution. As the paddle itself blocks the electric field, only the gap between the paddles allows the electric field to pass through. Therefore, the area on the substrate facing the paddle will have a "shadow", where the received quantity of electricity is less than that of the "non-shadow" area. If the degree of "shadowing" varies at different points on the substrate, the received quantity of electricity will be uneven, resulting in uneven plating height on the entire substrate.

Figure 19B:
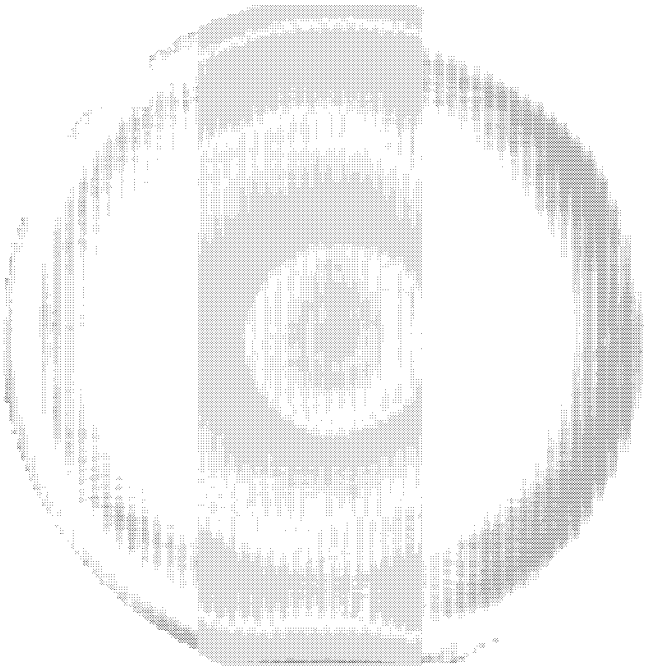
FIG. 19B shows an electroplating effect diagram using an electroplating apparatus of the present invention.
Figure 19A:
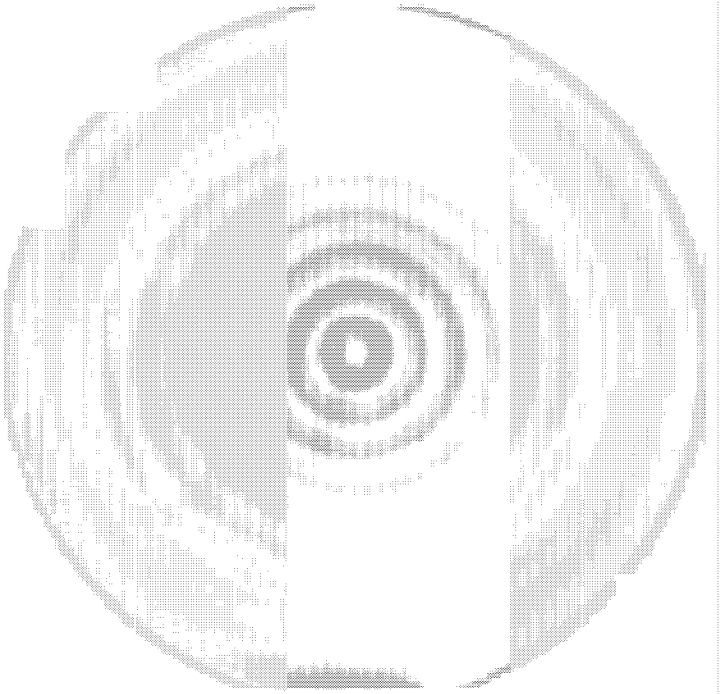
FIG. 19A shows an electroplating effect diagram using an existing electroplating apparatus.

During electroplating, the substrate rotates, and the result of the "shadowing" appears as concentric rings on the surface of the substrate, that is, significant fluctuations in the electroplating height along the radial direction of the substrate, as shown in FIG. 19A. The present invention aims to eliminate the "shadowing" effect and ensure consistent electroplating height at all points on the substrate.

First Embodiment

Figure 1:
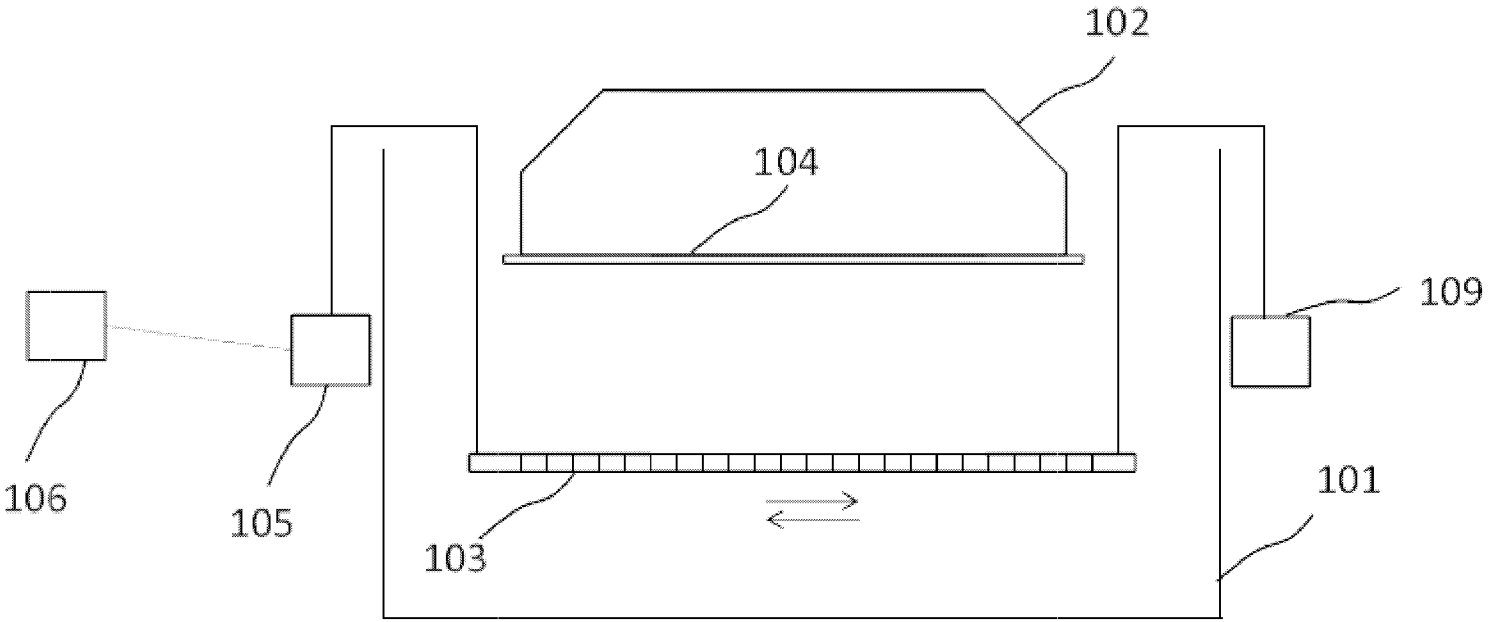
FIG. 1 illustrates a schematic diagram of an electroplating apparatus according to a first embodiment of the present invention.

As shown in FIG. 1, the present embodiment discloses an electroplating apparatus comprising an electroplating tank 101, a substrate holder 102, and a plurality of paddles 103 arranged in parallel. The substrate holder 102 is used to clamp the substrate 104, and the paddles 103 are located between the substrate 104 and the electrode, parallel to the substrate 104. During electroplating, the substrate 104 and the paddles 103 are immersed in the electroplating solution in the electroplating tank 101. The paddles 103 reciprocate along a direction parallel to the substrate 104 under the drive of a driving mechanism 105, which can be a motor, to agitate the electroplating solution. The movement direction of the paddles 103 can be further limited by the guide rail 109 connected to them. The driving mechanism 105 is connected to a controller 106, which controls the movement of the paddles 103 by programming the driving mechanism 105.

Figure 2:
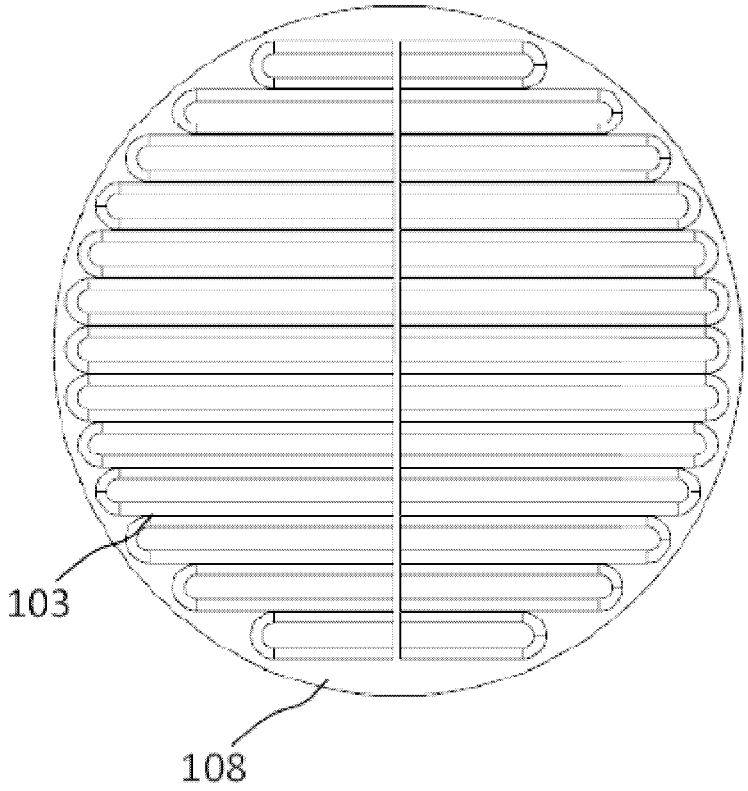
FIG. 2 shows a top view of a paddle board according to a first embodiment of the present invention.

As shown in FIG. 2, the paddles 103 are formed by rectangular through-holes in a paddle board 108. The material of the paddle board 108 is an insulator, such as PVC, PC, CPVC, PPS, PEEK, PTFE and other plastic materials. Specifically, parallel rectangular through-holes are processed in the circular area in the middle of the paddle board 108, through which the liquid and electric field can pass. The solid part between adjacent through-holes forms the paddles 103. The size of the circular area matches the size of the substrate 104.

Figure 3B:
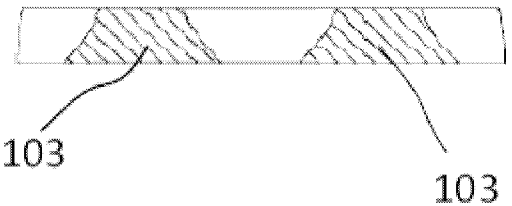
FIG. 3B is an enlarged view of part D in FIG. 3A.
Figure 3A:
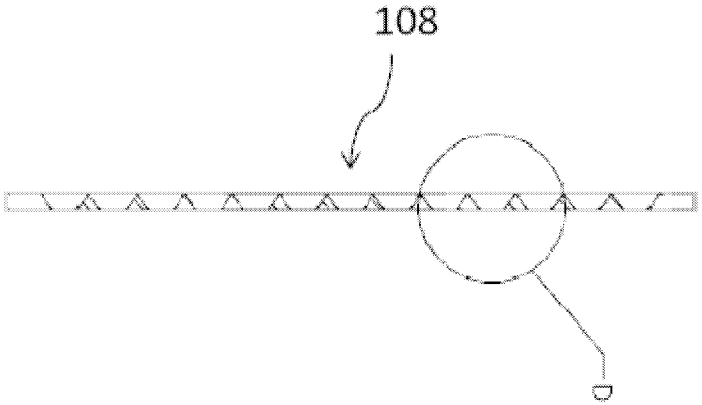
FIG. 3A illustrates a sectional view of a paddle board according to a first embodiment of the present invention.

As shown in FIG. 3A and FIG. 3B, the cross-section of the paddles 103 can be roughly trapezoidal, with the bases of each trapezoid located on the same line, which is the direction of the arrangement of the paddles 103. The two legs of the trapezoid have slight curvature.

The cross-section of the paddles 103 can also be triangular or rectangular. Compared the paddle board with rectangular paddles, the opening area of the paddle board with triangular or trapezoidal paddles is larger, so that the side of the paddle board 108 with a larger opening area faces the substrate 104, and the electroplating solution is stirred more fully on this side, thereby further improving the consistency of the plating height. On the other hand, since bubbles are easily generated on the side of the paddle 103 during high-speed stirring, the bubbles will adhere to the side of the paddle 103. If the side of the paddle 103 is designed as an inclined surface, the bubbles are more easily discharged from the paddle board 108.

Figure 4:
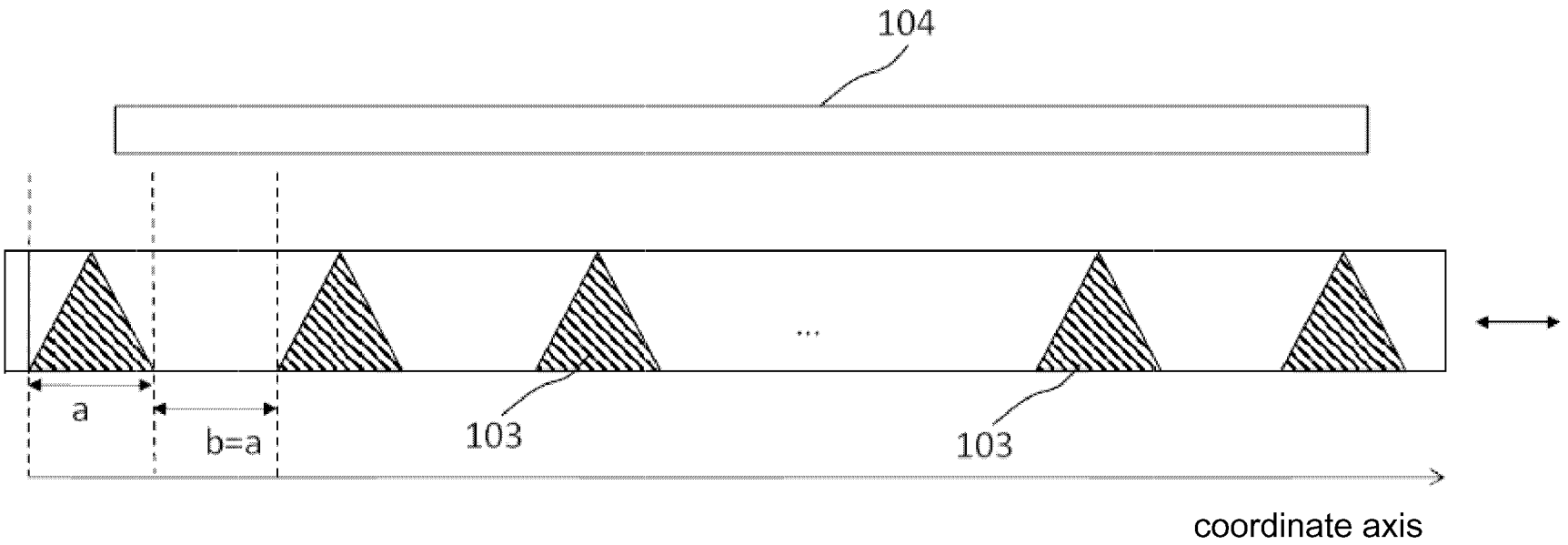
FIG. 4 shows the dimensions of a paddle according to a first embodiment of the present invention.

As shown in FIG. 4, taking the shape of an isosceles triangle as an example, the width of the paddle 103 is a. In other words, the width of the projection of the paddle 103 on the coordinate axis in the direction of the arrangement of the paddles 103 is a, which is the size of the base of the isosceles triangle. The narrowest width of the gap between adjacent paddles 103 is b. In other words, the distance between the two closest points on adjacent paddles 103 is b, which is the distance between the adjacent vertices of two adjacent isosceles triangles.

In this embodiment, a=b, that is, the opening rate of the opening area of the paddle board 108 at the bottom is 50%.

As shown by the arrow in FIG. 4, the movement direction of the paddles 103 is the same as the arrangement direction of the paddles 103, and is also perpendicular to the length direction of the paddles 103. Due to the obstruction of the electric field between the electrode and the substrate 104 caused by the paddles 103 itself, the area on the substrate 104 corresponding to the paddle 103 cannot receive electricity. However, the area on the substrate 104 corresponding to the gap between adjacent paddles 103 can receive electricity because there is no obstruction to the electric field between them. In the electroplating process, if each point on the substrate 104 can receive the same amount of electricity, the electroplating height at each point on the substrate 104 can be consistent. The applicant found that this requires optimization design of the size and the movement mode of the paddles 103.

Figure 5:
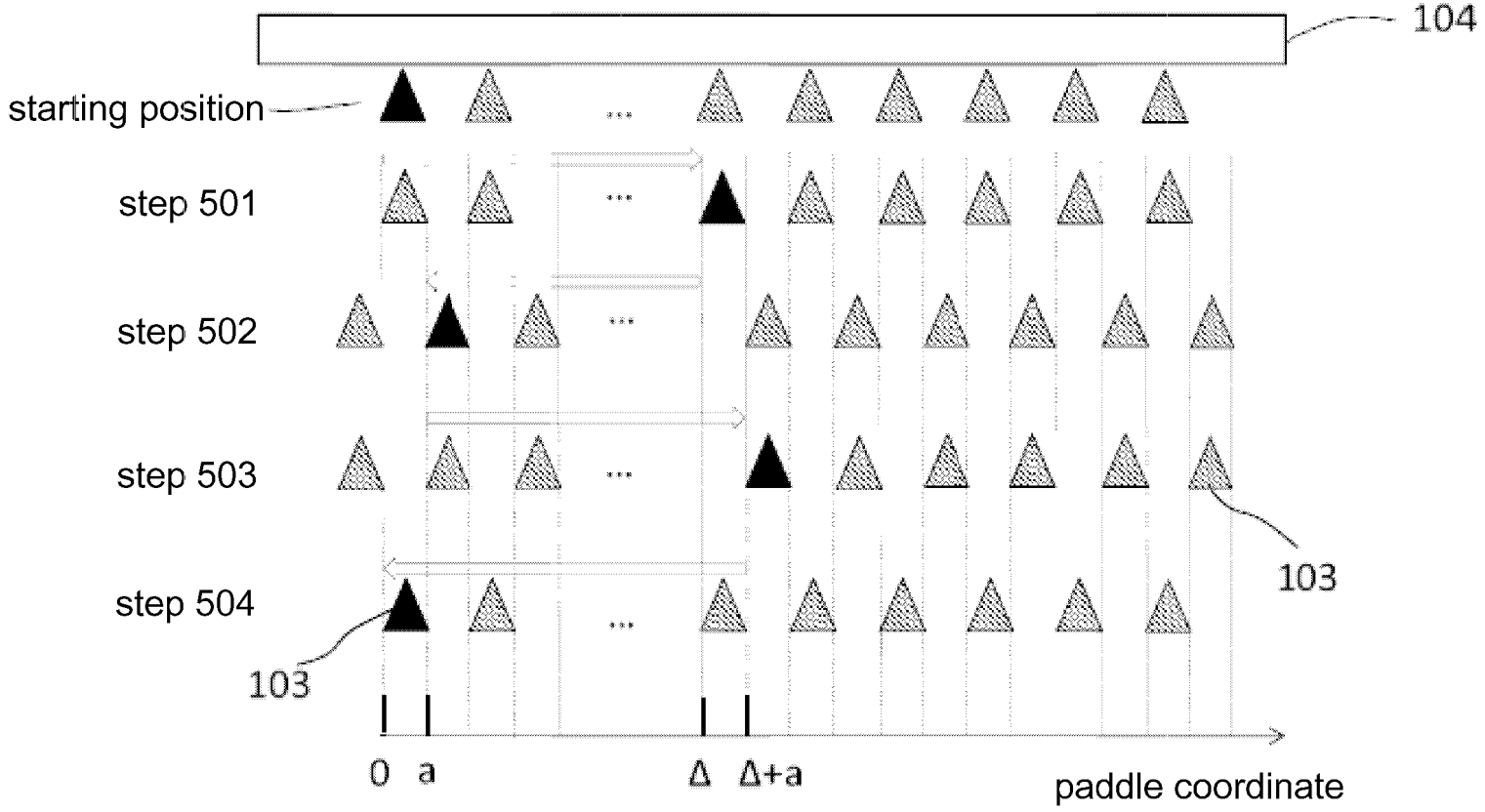
FIG. 5 illustrates the position changes of a paddle within one cycle according to a first embodiment of the present invention.

As shown in FIG. 5, the triangle represents the cross-section of the paddle 103. For ease of understanding, one of the paddles 103 is drawn as a black triangle. Since the relative positions of the paddles 103 do not change, the movement of all the paddles 103 is consistent with that of the selected black triangle paddle 103. Taking the arrangement direction of the paddles 103 as the direction of a one-dimensional coordinate axis, and taking the starting point of the selected black triangle paddle 103 as the origin of the coordinate system, specifically, taking the left end-point of the selected black triangle paddle 103 as the origin of the coordinate system, the paddle 103 reciprocates along the coordinate axis at the following four coordinate points: Δ, a, Δ+a, 0.

In order to facilitate the observation of the coordinate position of the paddle 103, multiple dashed lines perpendicular to the coordinate axis are drawn in FIG. 5, and ellipses indicate several paddles 103 that are not drawn. The arrow with a border indicates the displacement of the paddle 103. As can be seen from FIG. 5, the movement of the paddles 103 within one cycle is divided into the following four steps:

Step 501, moving right from the origin to the coordinate Δ;

Step 502, moving left to the coordinate a;

Step 503, moving right to the coordinate Δ+a;

Step 504, moving left back to the origin.

Within one cycle, the paddle 103 moves alternately from side to side. Since each point on the substrate 104 corresponding to the paddle 103 is blocked by the paddle 103 for an equal amount of time, when the electric field is evenly distributed, each point on the substrate 104 corresponding to the paddle 103 receives the same amount of quantity of electricity, and thus the electroplating height at each point is the same.

Within one cycle, to ensure that the coordinate ranges covered by the paddle 103 at each turning point do not overlap, it is required that that is, so that the stirring degree at each point during electroplating is more balanced. The width a of the paddle 103 can range from 5 mm to 15 mm, and can be set according to the size of the substrate 104 and the size of the parts of the electroplating apparatus. Taking a=5 mm and 4=15 mm as an example, the paddle 103 reverses at the following four coordinate points: 15 mm, 5 mm, 20 mm, 0 mm.

In the electroplating process, after completing one cycle of movement, the paddle 103 immediately enters the next cycle of movement.

Second Embodiment

The present embodiment discloses an electroplating apparatus, which includes all the structures of the electroplating apparatus in First embodiment, as shown in FIG. 1. It will not be repeated here.

Figure 6:
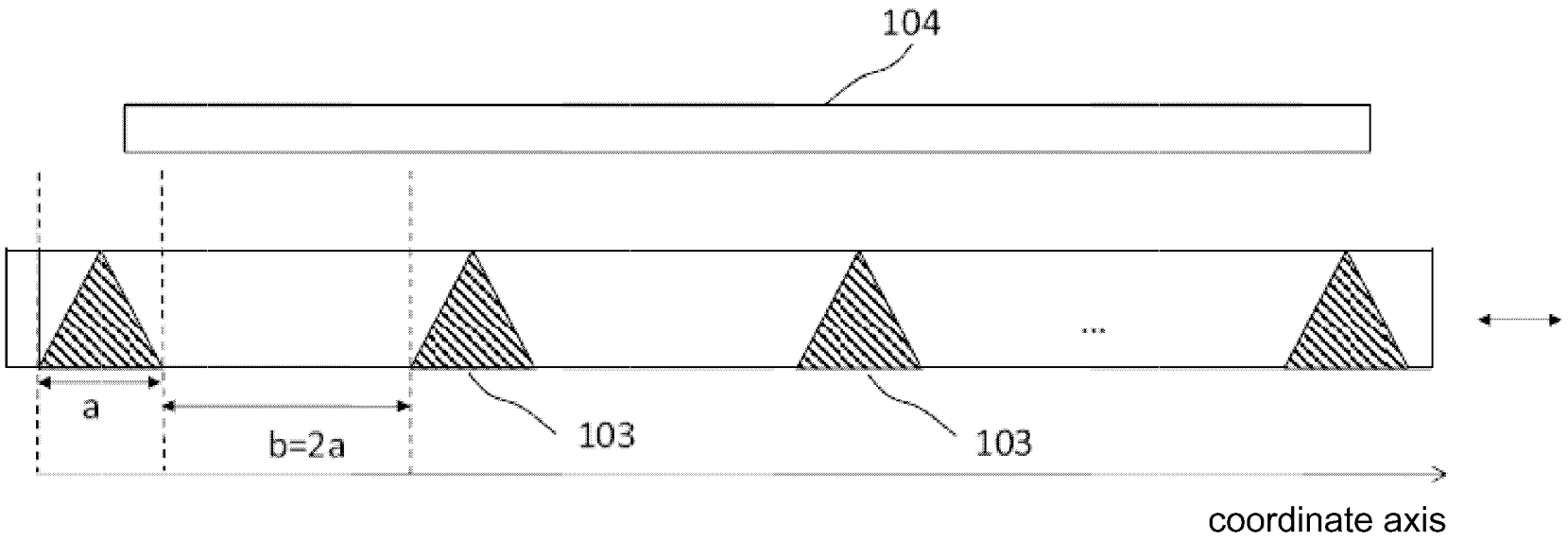
FIG. 6 shows the dimensions of a paddle according to a first embodiment of the present invention.
Figure 7:
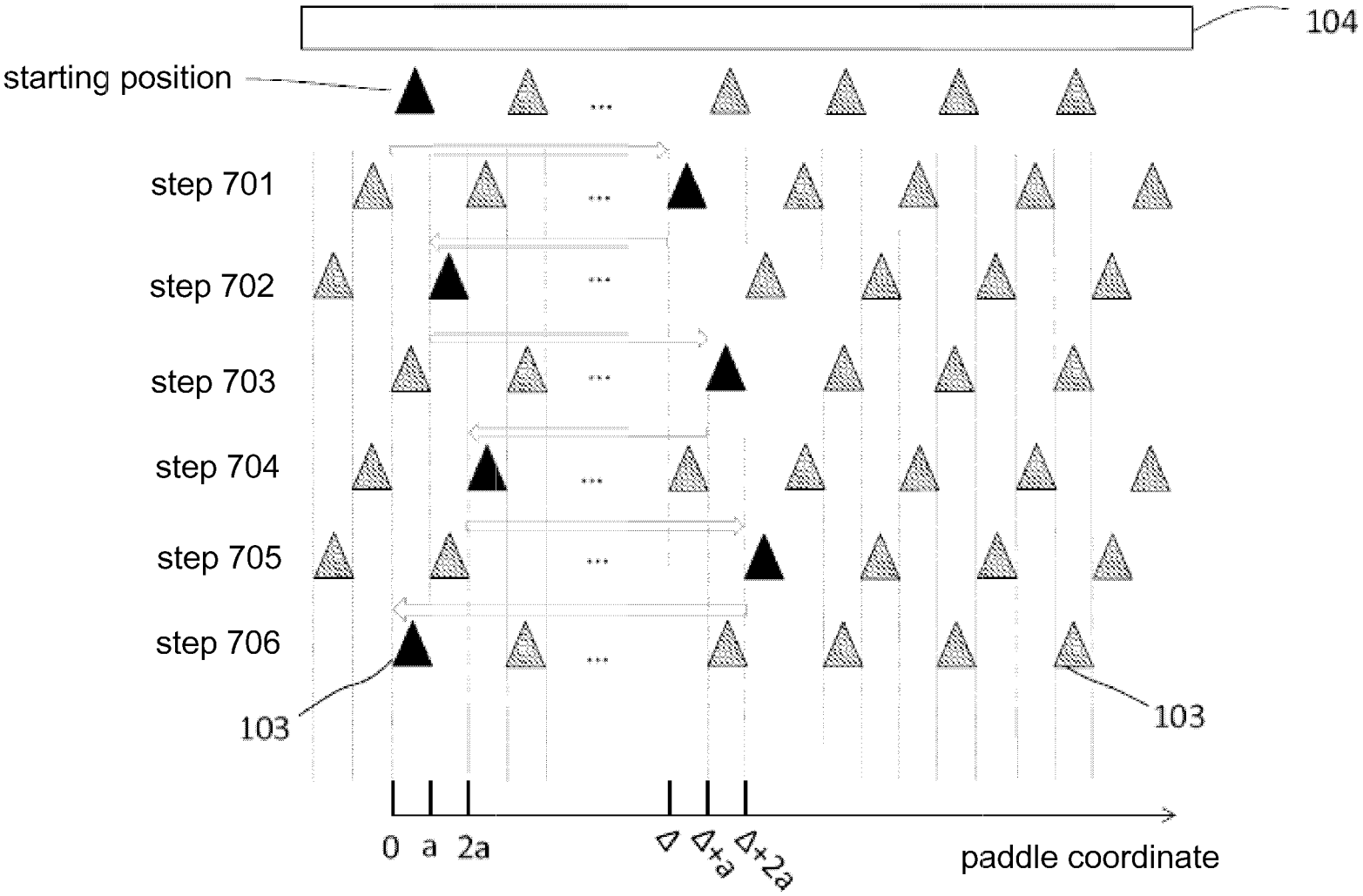
FIG. 7 illustrates the position changes of a paddle within one cycle according to a second embodiment of the present invention.

Unlike First embodiment, as shown in FIG. 6, b=2a, where a is the width of the paddle 103 and b is the narrowest width of the gap between adjacent paddles 103. The opening area at the bottom of the paddle plate 108 in this embodiment has a larger opening ratio, approximately 66.7%, compared to the 50% opening ratio. The paddle 103 itself will block the electric field less. Therefore, the movement of the paddle 103 is different. Within one cycle, the paddle 103 reverses at the following six coordinate points: Δ, a, Δ+a, 2a, Δ+2a, 0, as shown in FIG. 7. The movement of the paddle 103 consists of the following six steps:

Step 701: moving right from the origin to coordinate Δ;

Step 702: moving left to coordinate a

Step 703: moving right to coordinate Δ+a;

Step 704: moving left to coordinate 2a;

Step 705: moving right to coordinate Δ+2a;

Step 706: moving left back to the origin.

Within one cycle, the paddle 103 moves alternately from side to side. Since each point on the substrate 104 corresponding to the paddle 103 is blocked by the paddle 103 for an equal amount of time, when the electric field is evenly distributed, each point on the substrate 104 corresponding to the paddle 103 receives the same amount of quantity of electricity, and thus the electroplating height at each point is the same.

Within one cycle, to ensure that the coordinate ranges covered by the paddle 103 at each reversal position do not overlap, it is required that that is, Taking a=6 mm and 4=20 mm as an example, the paddle 103 reverses at the following six coordinate points: 20 mm, 6 mm, 26 mm, 12 mm, 32 mm, 0 mm.

Third Embodiment

The present embodiment discloses an electroplating apparatus, which includes all the structures of the electroplating apparatus in First embodiment, as shown in FIG. 1. It will not be repeated here.

Figure 8:
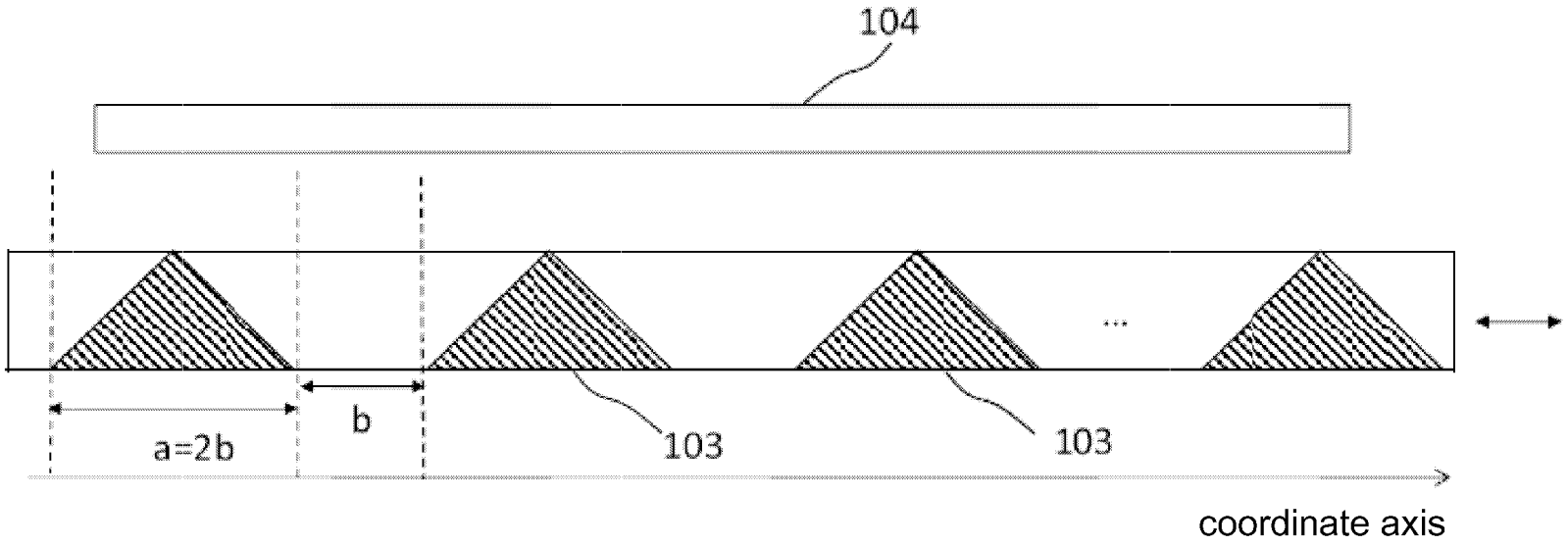
FIG. 8 shows the dimensions of a paddle according to a third embodiment of the present invention.

Unlike First embodiment, as shown in FIG. 8, a=2b, where a is the width of the paddle 103 and b is the narrowest width of the gap between adjacent paddles 103. The opening area at the bottom of the paddle plate 108 in this embodiment has a smaller opening ratio, approximately 33.3%. This size design can be considered as swapping the size of the paddle 103 in Second embodiment with the size of the gap between adjacent paddles 103. Therefore, the movement of the paddle 103 can be similar to that described in Second embodiment, where the paddle 103 reverses at the following six coordinate points: Δ, b, Δ+b, 2b, Δ+2b, 0.

Figure 9:
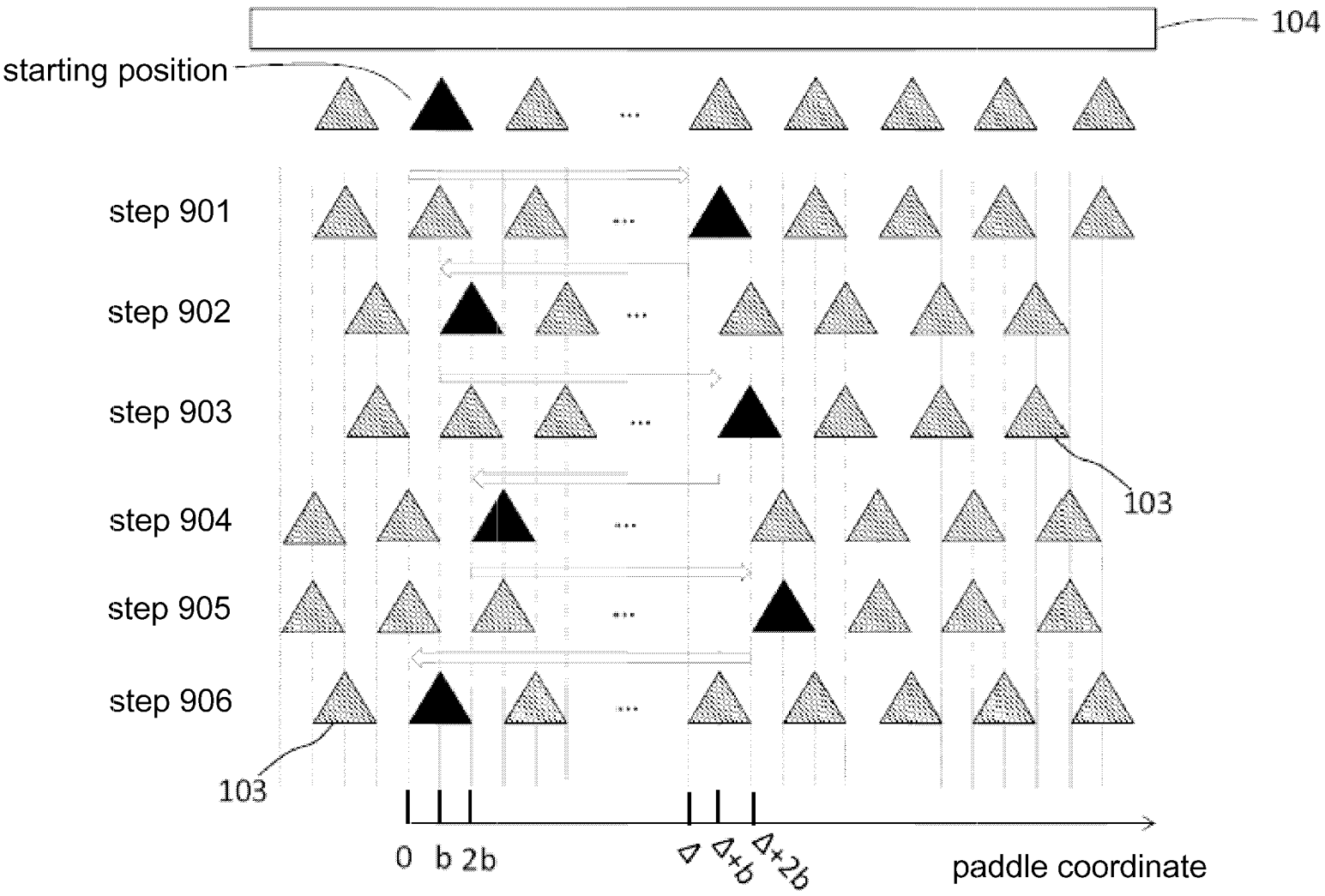
FIG. 9 illustrates the position changes of a paddle within one cycle according to a third embodiment of the present invention.

As shown in FIG. 9, the movement of the paddle 103 within one cycle consists of the following six steps:

Step 901: moving right from the origin to coordinate J.

Step 902: moving left to coordinate b.

Step 903: moving right to coordinate Δ+b.

Step 904: moving left to coordinate 2b.

Step 905: moving right to coordinate Δ+2b.

Step 906: moving left back to the origin by moving.

Within one cycle, the paddle 103 moves alternately from side to side. Since each point on the substrate 104 corresponding to the paddle 103 is blocked by the paddle 103 for an equal amount of time, when the electric field is evenly distributed, each point on the substrate 104 corresponding to the paddle 103 receives the same amount of quantity of electricity, and thus the electroplating height at each point is the same.

Similarly, within one cycle, to make the coordinates at which the paddle 103 reverses as dispersed as possible, Δ≥a+b is required, that is, Δ≥3b. Taking b=10 mm and Δ=35 mm as an example, the coordinates at which the paddle 103 pauses are: 35 mm, 10 mm, 45 mm, 20 mm, 55 mm, 0 mm.

Fourth Embodiment

In First embodiment to Third embodiment, the multiple between the width a of the paddle 103 and the narrowest width b of the gap between adjacent paddles 103 is an integer. For an electroplating apparatus where the multiple between the width a of the paddle 103 and the narrowest width b of the gap between adjacent paddles 103 is an integer, the present embodiment discloses the following electroplating method:

Execute the program in the controller to move the paddle 103 as follows: within one cycle, the movement steps of the paddle 103 are:

moving from the origin to coordinate Δ in the direction of the arrangement of the paddle 103;

moving to coordinate c in the opposite direction;

moving to coordinate Δ+c in the direction of the arrangement of the paddle 103;

moving to coordinate 2c in the opposite direction;

. . .

moving to coordinate Δ+(N−1)*c in the direction of the arrangement of the paddle 103;

moving to coordinate N*c in the opposite direction;

moving to coordinate Δ+N*c in the direction of the arrangement of the paddle 103;

moving back to the origin in the opposite direction.

Wherein, $$\Delta \geqslant a+b,\ c=\begin{cases} a, & a<b \\ b, & a\geq b \end{cases},\ b=N*a \text{ or } a=N*b,$$

N is an integer.

On the one hand, the alternating movement of the paddle 103 can make the distribution of metal ions and electroplating additives in the electroplating solution uniform. On the other hand, each point on the substrate 104 corresponding to the paddle 103 is blocked by the paddle 103 for an equal amount of time, which can make the electroplating height of each point on the substrate 104 corresponding to the paddle 103 the same.

Alternatively, within one cycle, the paddle 103 can move as follows:

moving from the origin to coordinate Δ in the direction of the arrangement of the paddle 103;

moving to coordinate c in the opposite direction;

moving to coordinate Δ+c in the direction of the arrangement of the paddle 103;

moving to coordinate 2c in the opposite direction;

. . .

moving to coordinate Δ+(N−1)*c in the direction of the arrangement of the paddle 103;

moving to coordinate N*c in the opposite direction;

moving to coordinate Δ+N*c in the direction of the arrangement of the paddle 103;

moving to coordinate N*c in the opposite direction;

moving to coordinate Δ+(N−1)*c in the direction of the arrangement of the paddle 103;

. . .

moving to coordinate 2c in the opposite direction;

moving to coordinate Δ+c in the direction of the arrangement of the paddle 103;

moving to coordinate c in the opposite direction;

moving to coordinate Δ in the direction of the arrangement of the paddle 103;

moving back to the origin in the opposite direction;

moving to coordinate Δ+N*c in the direction of the arrangement of the paddle 103;

moving back to the origin in the opposite direction.

Figure 10:
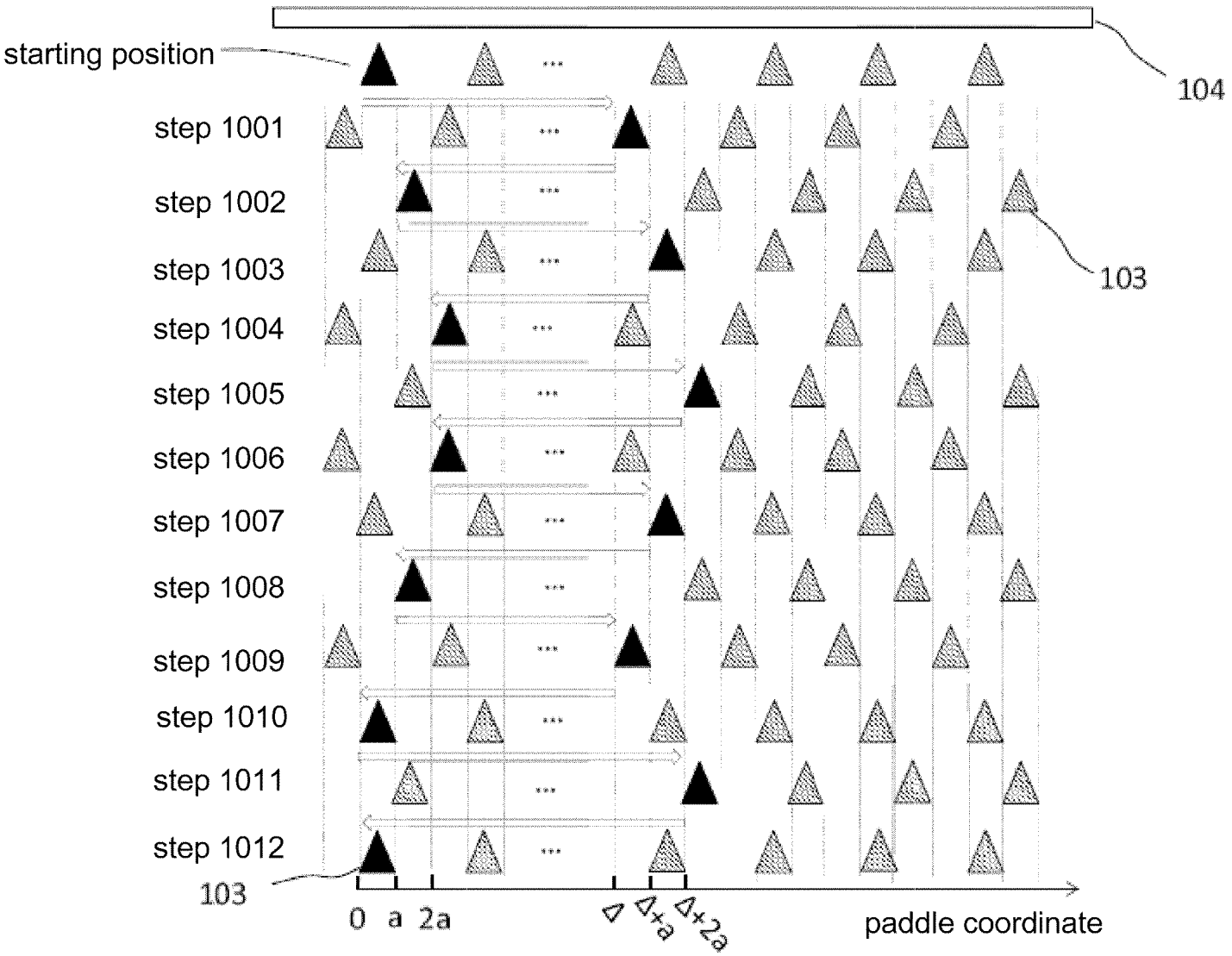
FIG. 10 illustrates one way of the position changes of a paddle within one cycle according to a fourth embodiment of the present invention.

To display the position of the paddle 103 at each turning point more intuitively, taking b=2a as an example, the movement of the paddle 103 within one cycle is divided into the following 12 steps, as shown in FIG. 10:

Step 1001, moving from the origin to coordinate Δ in the direction of the arrangement of the paddle 103;

Step 1002, moving to coordinate a in the opposite direction;

Step 1003, moving to coordinate Δ+a in the direction of the arrangement of the paddle 103;

Step 1004, moving to coordinate 2a in the opposite direction;

Step 1005, moving to coordinate Δ+2a in the direction of the arrangement of the paddle 103;

Step 1006, moving to coordinate 2a in the opposite direction;

Step 1007, moving to coordinate Δ+a in the direction of the arrangement of the paddle 103;

Step 1008, moving to coordinate a in the opposite direction;

Step 1009, moving to coordinate Δ in the direction of the arrangement of the paddle 103;

Step 1010, moving back to the origin in the opposite direction;

Step 1011, moving to coordinate Δ+2a in the direction of the arrangement of the paddle 103;

Step 1012, moving back to the origin in the opposite direction.

Similarly, the time that each point on the substrate 104 corresponding to the paddle 103 is blocked is equal, so the received quantity of electricity is equal and the electroplating height is consistent.

Fifth Embodiment

The present embodiment discloses an electroplating apparatus, which includes all the structures of the electroplating apparatus in First embodiment, as shown in FIG. 1. It will not be repeated here.

Figure 11:
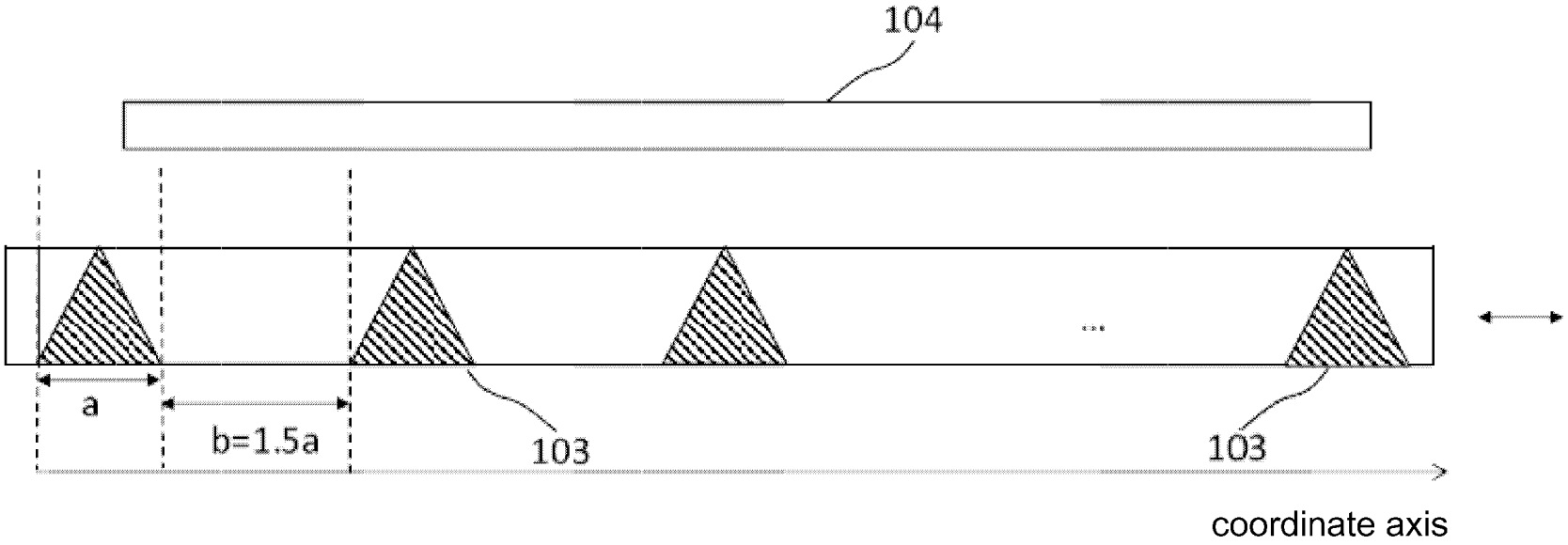
FIG. 11 shows the dimensions of a paddle according to a fifth embodiment of the present invention.

Unlike First embodiment, as shown in FIG. 11, b=1.5a, where the width of the paddle 103 is a and the narrowest width of the gap between adjacent paddles 103 is b.

Figure 12:
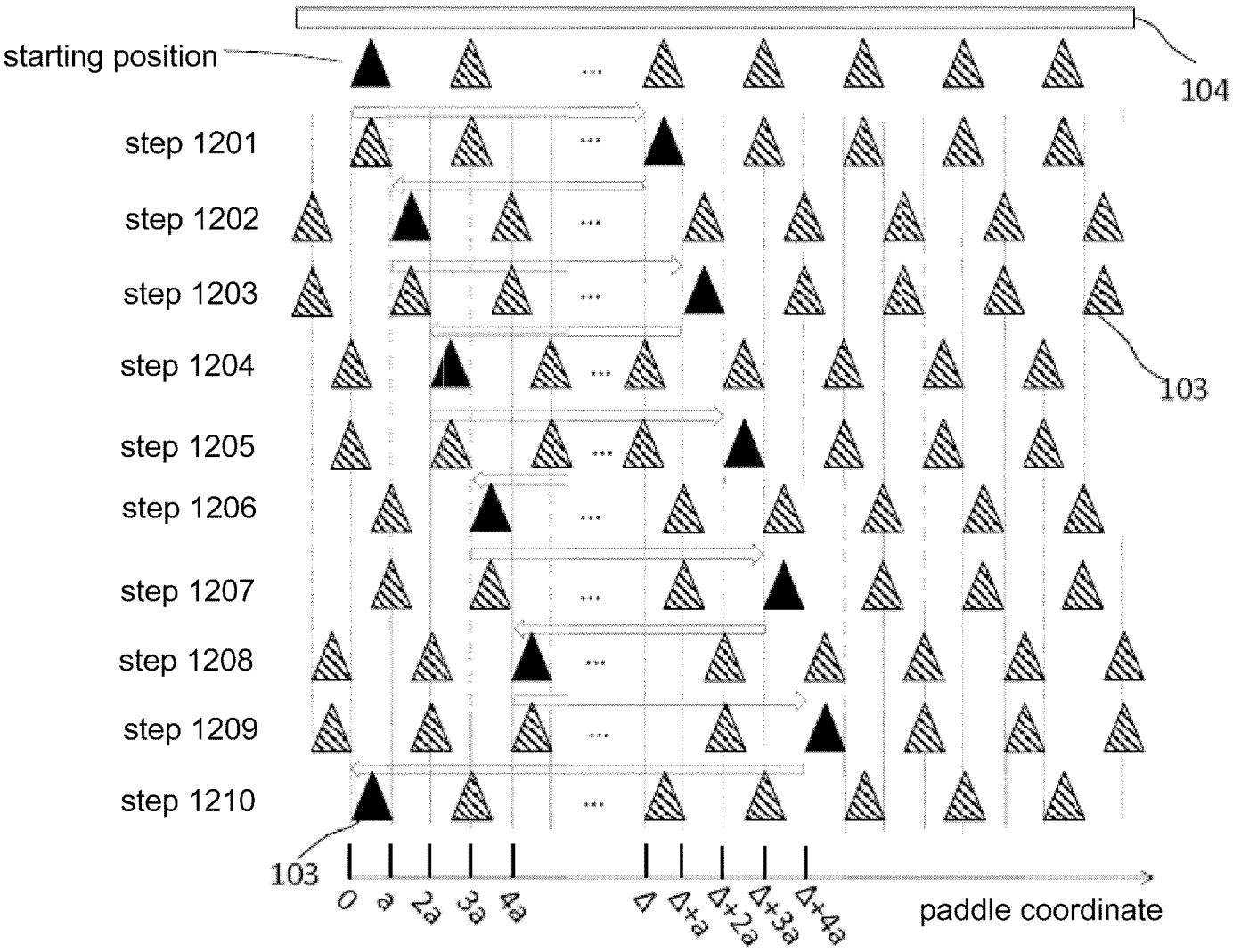
FIG. 12 illustrates the position changes of a paddle within one cycle according to a fifth embodiment of the present invention.

As shown in FIG. 12, the paddle 103 reverses at the following 10 coordinate points:

$$\Delta,\ a,\ \Delta+a,\ 2a,\ \Delta+2a,\ 3a,\ \Delta+3a,\ 4a,\ \Delta+4a,\ 0.$$

Within one cycle, the movement of the paddle 103 includes the following 10 steps:

Step 1201, moving from the origin to coordinate Δ in the direction of the arrangement of the paddle 103;

Step 1202, moving to coordinate a in the opposite direction;

Step 1203, moving to coordinate Δ+a in the direction of the arrangement of the paddle 103;

Step 1204, moving to coordinate 2a in the opposite direction;

Step 1205, moving to coordinate Δ+2a in the direction of the arrangement of the paddle 103;

Step 1206, moving to coordinate 3a in the opposite direction;

Step 1207, moving to coordinate Δ+3a in the direction of the arrangement of the paddle 103;

Step 1208, moving to coordinate 4a in the opposite direction;

Step 1209, moving to coordinate Δ+4a in the direction of the arrangement of the paddle 103;

Step 1210, moving back to the origin in the opposite direction.

Within one cycle, the time that each point on the substrate 104 corresponding to the paddle 103 is blocked is equal. When the electric field is uniformly distributed, each point on the substrate 104 corresponding to the paddle 103 receives an equal amount of quantity of electricity, so the electroplating height of each point is the same.

Sixth Embodiment

In Fifth embodiment, the multiple between the width a of the paddle 103 and the narrowest gap b between adjacent paddles 103 is a non-integer greater than 1. For the electroplating apparatus with a non-integer multiple between a and b greater than 1, the following electroplating method is disclosed in this example:

Execute the program in the controller to move the paddle 103 as follows: Within one cycle, the movement steps of the paddle are:

moving right from the origin to coordinate Δ;

moving left to coordinate c moving right to coordinate Δ+c;

moving left to coordinate 2c to the left;

. . .

moving right to coordinate Δ+(y−2)*c to the right;

moving left to coordinate (y−1)*c to the left;

moving right to coordinate Δ+(y−1)*c to the right;

moving left to the origin to the left;

Wherein Δ≥a+b, a is the width of the paddle, b is the narrowest gap between adjacent paddles, $$c=\begin{cases} a, & a<b \\ b, & a\geq b \end{cases},\ y=x*(N+1),\ b=N*a \text{ or } a=N*b,$$

N is a non-integer greater than 1, and x is a value that makes x*N be an integer.

To understand this method, imagine that c is the smaller value between a and b, and use several small grids with a width of c to fill a large grid with a width of x*(a+b), where x is an integer. Each small grid is arranged along the width direction, the covered positions do not overlap, and the large grid is filled without leaving any gaps. By selecting a suitable value of x, x*(a+b) can be a multiple of c, which satisfies the requirement. x*(a+b) being a multiple of c is equivalent to x*(N+1) being an integer, that is, x*N is an integer.

The small grids with a width of c are regarded as the paddle 103 with a width of c, x*(N+1) is regarded as the number of return points in a group, and the large grid with a width of x*(a+b) is regarded as the coordinate range covered by the paddle 103 at the return points in the group. The description of filling the large grid with small grids can be regarded as achieving the effect of "the time that each point on the substrate 104 corresponding to the paddle 103 is blocked is equal" mentioned in Fifth embodiment. Since there are two groups of return points within one cycle, the number of return points within one cycle is 2x*(N+1). To simplify the expression, let y x*(N+1), then the coordinates of the first group of return points are 0, c, 2c, . . . , (y−2)*c, (y−1)*c, and the coordinates of the second group of return points are Δ, Δ+c, Δ+2c, . . . , Δ+(y−2)*c, Δ+(y−1)*c.

Within one cycle, the movement steps of the paddle 103 can also be:

moving right from the origin to coordinate
moving left to coordinate c;
moving right to coordinate Δ+c;
moving left to coordinate 2c;
. . .
moving right to coordinate Δ+(y−2)*c to the right;
moving left to coordinate (y−1)*c;
moving right to coordinate Δ+(y−1)*c;
moving left to coordinate (y−1)*c;
moving right to coordinate Δ+(y−2)*c;
. . .
moving left to coordinate 2c;
moving right to coordinate Δ+c;
moving left to coordinate c;
moving right to coordinate Δ;
moving left to the origin;
moving right to coordinate Δ+(y−1)*c;
moving left to the origin.

Similarly, each point on the substrate 104 corresponding to the paddle 103 is covered for an equal amount of time, and the received quantity of electricity is equal, resulting in a consistent electroplating height.

Seventh Embodiment

This example discloses an electroplating apparatus that includes all the structures of the electroplating apparatus in First embodiment, which will not be repeated here.

Figure 13:
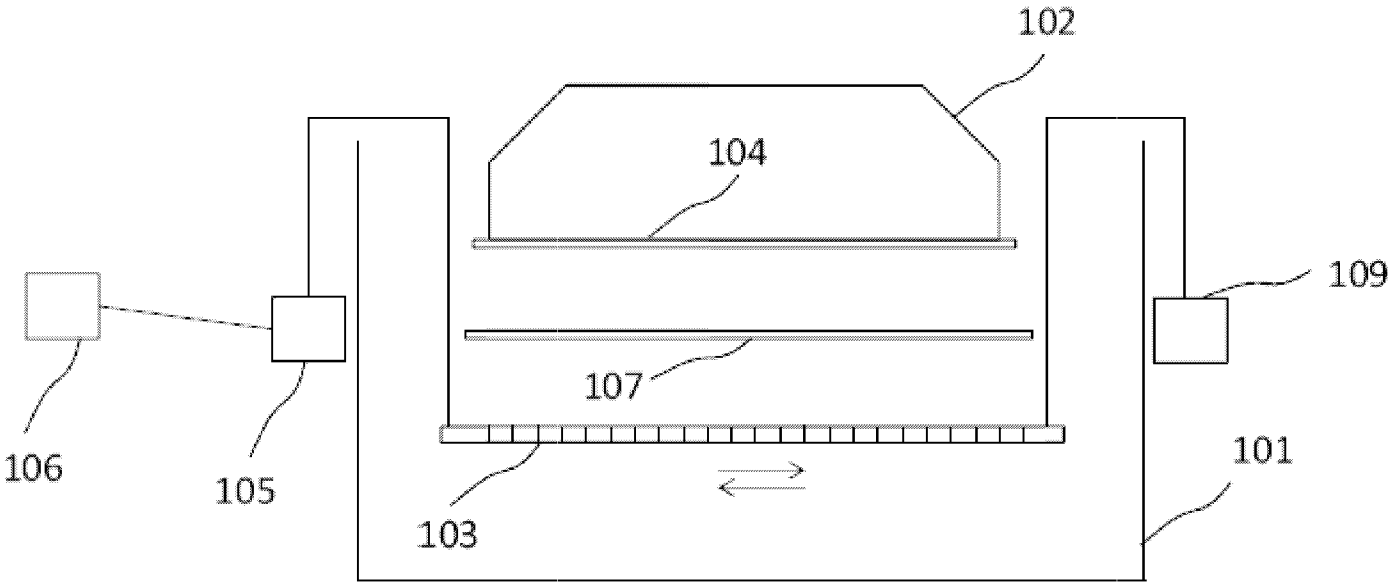
FIG. 13 illustrates a schematic diagram of an electroplating apparatus in the according to a seventh embodiment of the present invention.

In addition, as shown in FIG. 13, the electroplating apparatus in this example further includes a diffusion plate 107 set between the paddle 103 and the substrate 104. The diffusion plate 107 has multiple through-holes, and by setting the density and aperture of the through-holes, the consistency of the electroplating height at each point on the substrate can be further improved.

Figure 14:
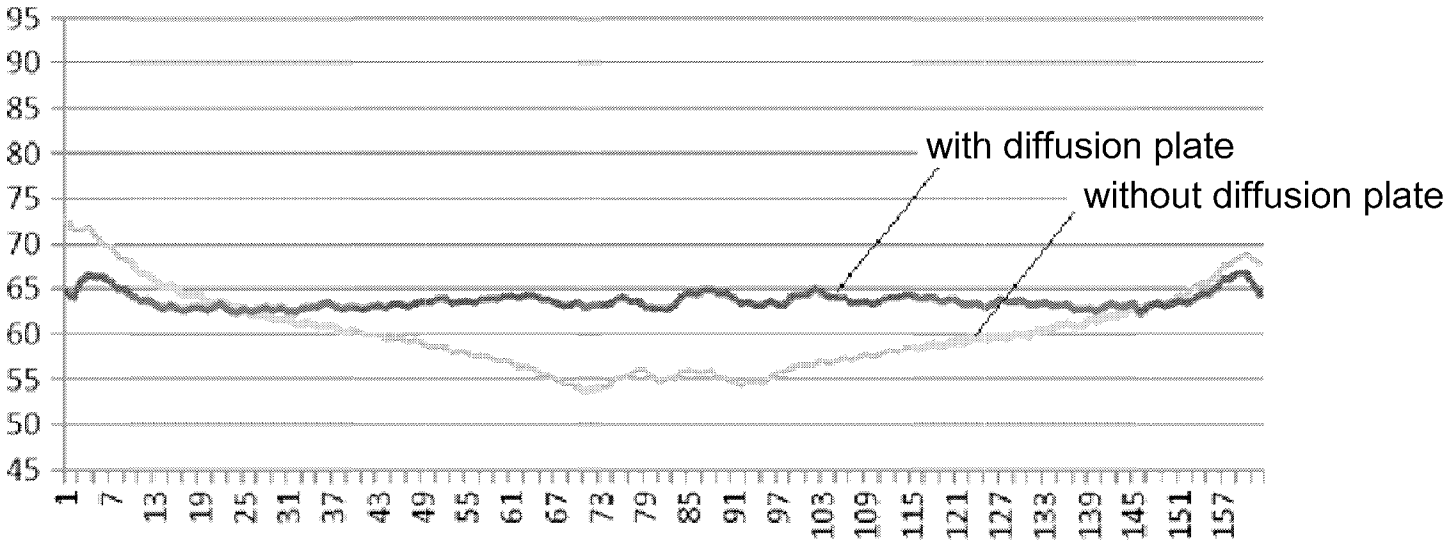
FIG. 14 shows a comparison of an electroplating result curves between an electroplating apparatus with a diffusion plate and an electroplating apparatus without a diffusion plate according to a seventh embodiment of the present invention.

To compare the electroplating results of an electroplating apparatus without the diffusion plate 107 and an electroplating apparatus with the diffusion plate 107 of the present invention, FIG. 14 shows the electroplating result curves of the two electroplating apparatus. The horizontal axis represents the distance between the test point and the center point of the substrate, and the vertical axis represents the electroplating height of the test point. It can be seen that the electroplating apparatus with the diffusion plate can achieve a more consistent electroplating height.

Eighth Embodiment

The present embodiment discloses an electroplating apparatus, which includes all the structures of the electroplating apparatus in First embodiment, as shown in FIG. 1. It will not be repeated here.

Figure 15:
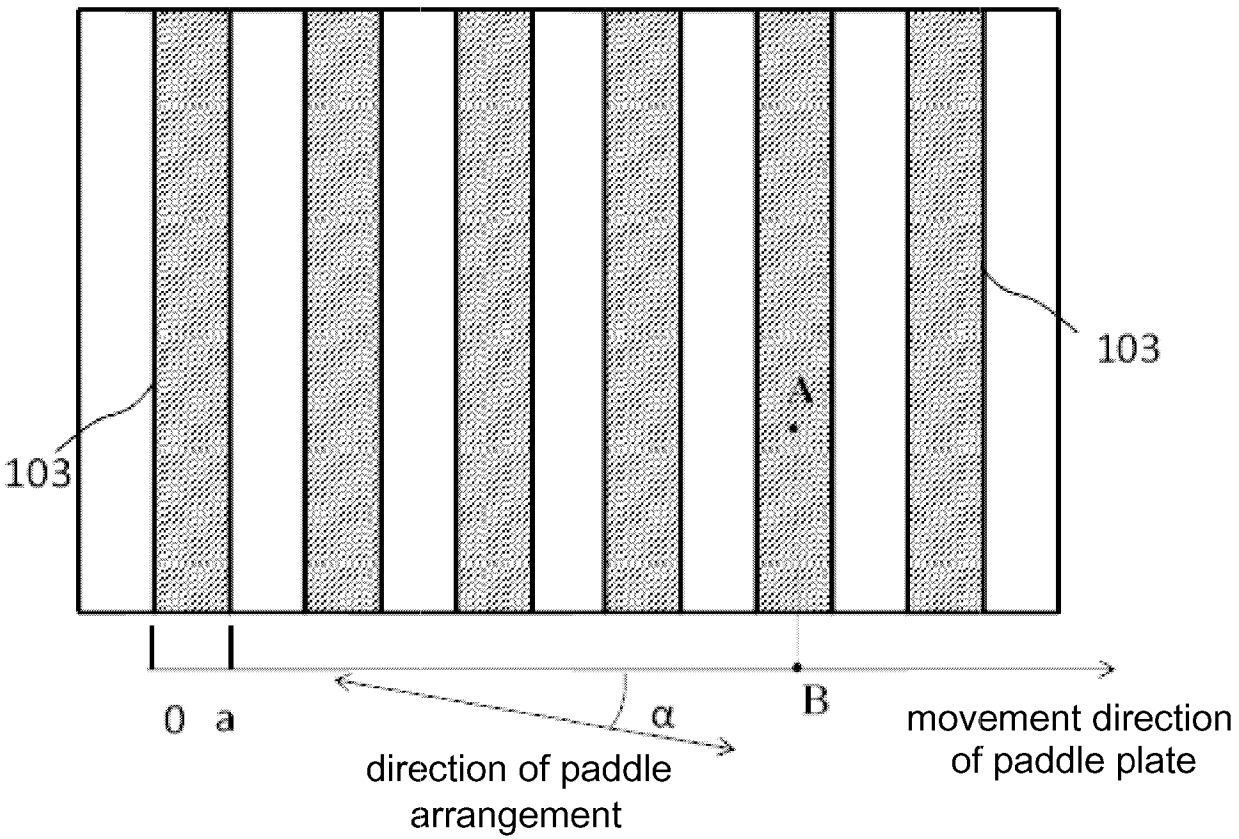
FIG. 15 illustrates a coordinate position diagram of a paddle according to an eighth embodiment of the present invention.

Unlike First embodiment, the paddle 103 has an angle α with the coordinate axis in the direction of the paddle arrangement, where a is less than 90°. Therefore, the coordinate of the paddle 103 is the projection of the actual position of the paddle 103 on the coordinate axis. As shown in FIG. 15, if the actual position of a point on the paddle 103 is point A, the coordinate position of the point is the projection point B of point A on the coordinate axis. This can be understood as follows: since only the component of the paddle 103's movement in the direction of the coordinate axis will cause a change in the amount of electricity received by the corresponding area on the substrate 104, only the coordinate change of the paddle 103 on the coordinate axis is considered.

Obviously, due to the existence of the angle α, the actual distance the paddle 103 moves are greater, so the size of the angle α can be set according to the actual situation.

Ninth Embodiment

The present embodiment discloses an electroplating apparatus, which includes all the structures of the electroplating apparatus in First embodiment, as shown in FIG. 1. It will not be repeated here.

Figure 16:
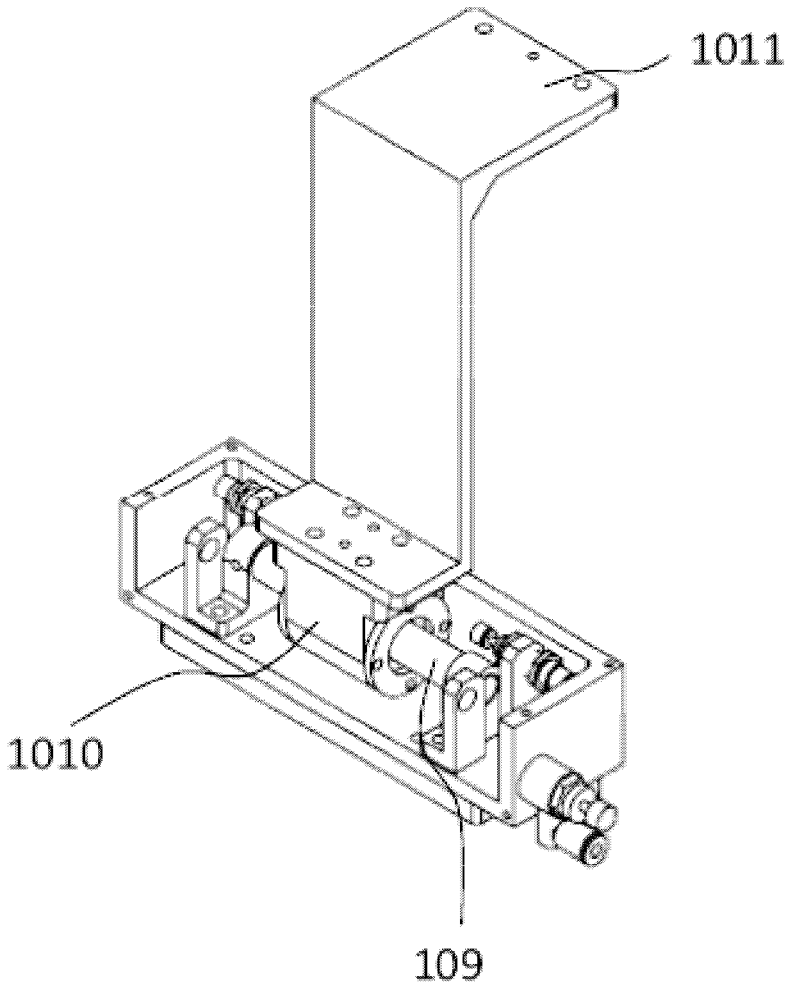
FIG. 16 illustrates a connection structure diagram of a paddle board and the guide rail according to a ninth embodiment of the present invention.

Furthermore, as shown in FIG. 16, one side of the paddle plate 108 is connected to the eccentric bearing 1010 through a connecting member 1011, and the eccentric bearing 1010 is slidably connected to the guide rail 109. The paddle plate 108 is driven by the driving mechanism 105 to move. Without the eccentric bearing 1010, the movement of the paddle plate 108 should be along the direction of the guide rail 109. If the driving mechanism causes the paddle plate 108 to move in other directions, the paddle plate 108 will be stuck by the guide rail 109. The function of the eccentric bearing 1010 is to allow for slight deviations between the movement direction of the paddle plate 108 and the direction of the guide rail, preventing the movement of the paddle plate 108 from being obstructed due to installation errors.

Figure 17:
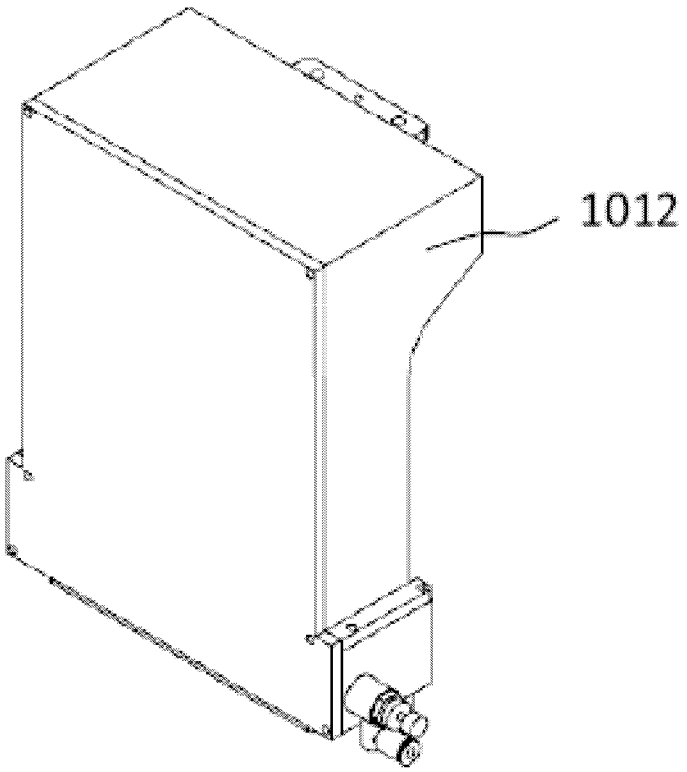
FIG. 17 illustrates a nitrogen protection box used to surround an eccentric bearing and a guide rail according to a ninth embodiment of the present invention

To prevent corrosive gases from corroding precision components, the driving mechanism 105, eccentric bearing 1010, and guide rail 109 are surrounded by a nitrogen protection box 1012. FIG. 17 shows the eccentric bearing 1010 and guide rail 109 surrounded by the nitrogen protection box 1012, which has a nitrogen inlet and a nitrogen outlet. The nitrogen protection box 1012 is kept filled with nitrogen, and external gases cannot enter the nitrogen protection box 1012 to corrode the internal precision components. Similarly, the driving mechanism 105 can also be surrounded by another nitrogen protection box.

Tenth Embodiment

The present embodiment discloses an electroplating apparatus, which includes all the structures of the electroplating apparatus in First embodiment, as shown in FIG. 1. It will not be repeated here.

Figure 18:
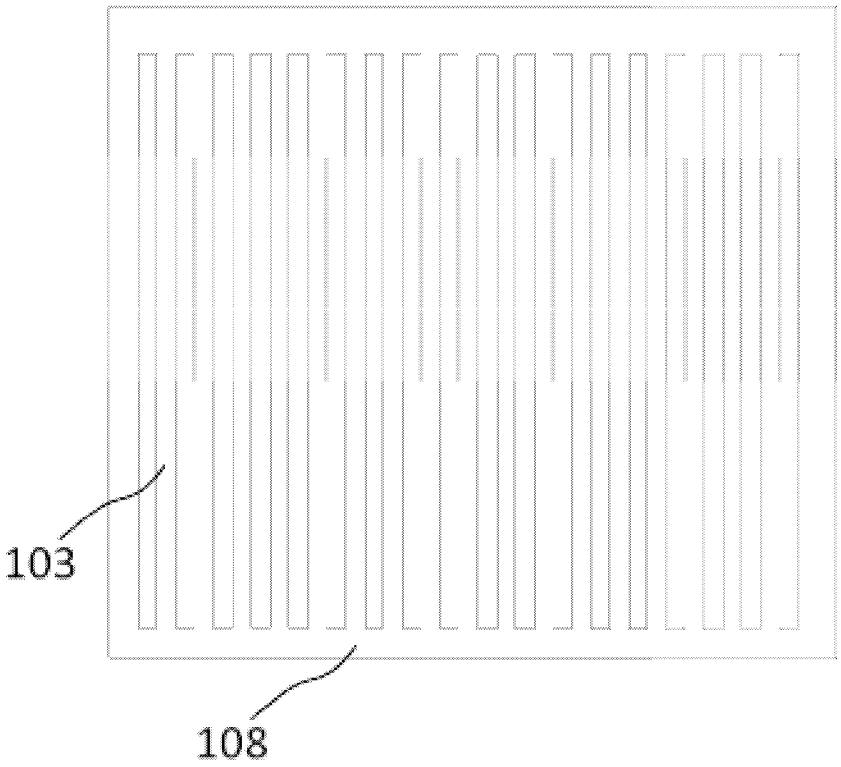
FIG. 18 illustrates a schematic diagram of a paddle board according to a tenth embodiment of the present invention.

Unlike First embodiment, as shown in FIG. 18, the shape of the paddle plate 108 is square, suitable for electroplating square substrates. Correspondingly, the paddle 103 is formed by opening a strip through-hole in the square area in the middle of the paddle plate 108.

It should be noted that the limitation of the coordinate of the paddle 103 in each embodiment of the present invention is to reflect the translation distance of the paddle 103. In an electroplating process, the origin position of the coordinate axis can be arbitrarily specified.

Figure 19C:
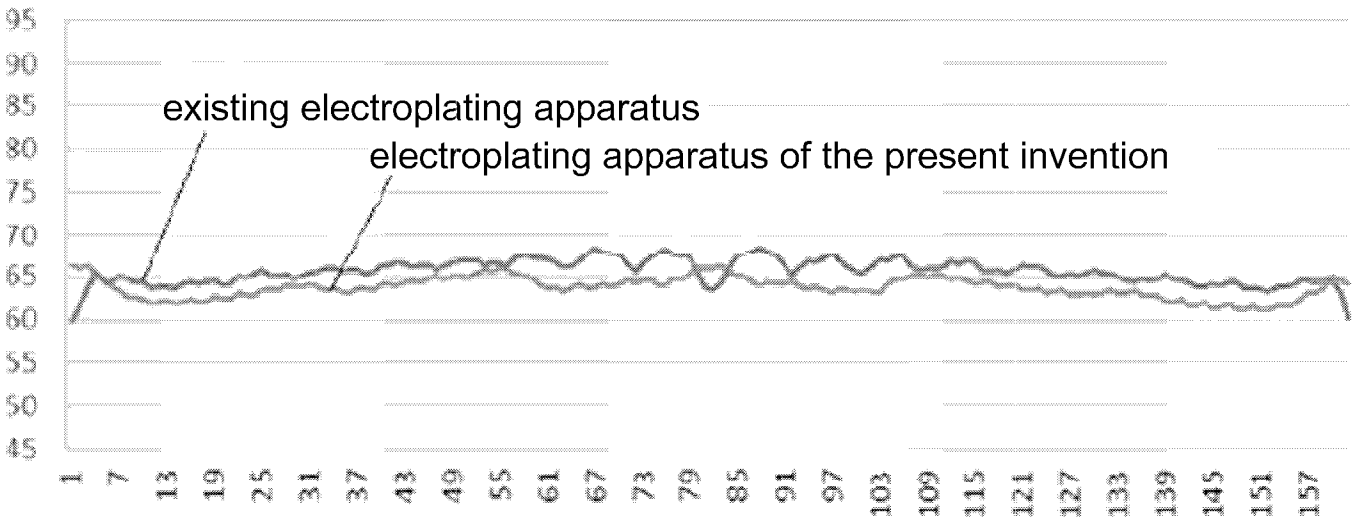
FIG. 19C shows a comparison of electroplating height data of test points on the substrate using an existing electroplating apparatus and an electroplating apparatus of the present invention.

To demonstrate the effect achieved by the present invention, FIG. 19A, FIG. 19B, and FIG. 19C respectively show the electroplating effect of the substrate using an existing electroplating apparatus, the electroplating effect of the substrate using the electroplating apparatus of the present invention, and the electroplating height data of the test points on the substrate. Compared with FIG. 19B, the concentric circles on the substrate in FIG. 19A are more obvious, and the electroplating height is uneven. In FIG. 19C, the horizontal axis represents the distance between the test point and the center point of the substrate, and the vertical axis represents the electroplating height of the test point. It can be seen from FIG. 19C that using the existing electroplating apparatus, there is a large fluctuation in the electroplating height along the radial direction of the substrate, which is more obvious in the area near the center of the substrate. Using the electroplating apparatus of the present invention, the electroplating height of each point of the substrate is more consistent, and the small differences in electroplating height between different points are related to other factors and are within an acceptable range.

In summary, the present invention has been specifically and comprehensively disclosed through the above embodiments and related diagrams, enabling those skilled in the art to implement the invention. The above embodiments are only used to illustrate the present invention and are not intended to limit the scope of the present invention. The scope of the present invention should be defined by the claims of the present invention. Changes in the number of components or the substitution of equivalent components as described in this document should also be within the scope of the present invention.

What is claimed is:

1. An electroplating apparatus, comprising: multiple parallel paddles, the paddles being arranged parallel to a substrate and moving to stir electroplating solution, wherein the electroplating apparatus further comprises a controller and a driving mechanism, the driving mechanism being connected to the controller and the paddles respectively, and the controller is programmed to control the driving mechanism to drive the paddles to move periodically so that each corresponding point on the substrate accumulated time blocked by the paddles is equal within a cycle;

taking the arrangement direction of the paddles as a coordinate axis direction, the movement steps of the paddles within the cycle comprising the following movement steps performed in succession:

moving right from a coordinate origin to coordinate 4 without overshooting;

moving left to coordinate c without overshooting;

moving right to coordinate Δ+c without overshooting;

moving left to coordinate 2c without overshooting;

alternately moving right and left until reaching:

moving right to coordinate Δ+(N−1)*c without overshooting;

moving left to coordinate N*c without overshooting;

moving right to coordinate Δ+N*c without overshooting;

moving left back to the coordinate origin without overshooting;

wherein Δ≥a+b and is a finite value, a is the width of the paddle, b is the narrowest width of the gap between adjacent paddles, $$c = \begin{cases} a, & a < b \\ b, & a \geq b \end{cases}, \; b = N * a \text{ or } a = N * b,$$

and N is a positive integer.

2. The electroplating apparatus according to claim 1, wherein a diffusion plate is provided between the paddles and the substrate, and the diffusion plate has multiple through-holes.

3. The electroplating apparatus according to claim 1, wherein the electroplating apparatus is provided with a guide rail, and the paddles are formed by opening strip-shaped through-holes on a paddle plate, one side of which is connected to a driving mechanism and the other side is slidably connected to the guide rail via an eccentric bearing.

4. The electroplating apparatus according to claim 3, wherein the driving mechanism, eccentric bearing, and guide rail are surrounded by a nitrogen protection box, and the nitrogen protection box is provided with a nitrogen inlet and a nitrogen outlet.

5. An electroplating apparatus, comprising: multiple parallel paddles, the paddles being arranged parallel to a substrate and moving to stir electroplating solution, wherein the electroplating apparatus further comprises a controller and a driving mechanism, the driving mechanism being connected to the controller and the paddles respectively, and the controller is programmed to control the driving mechanism to drive the paddles to move periodically so that each corresponding point on the substrate accumulated time blocked by the paddles is equal within a cycle;

taking the arrangement direction of the paddles as a coordinate axis direction, the movement steps of the paddles within the cycle comprising the following movement steps performed in succession:

moving right from an origin to coordinate Δ without overshooting;

moving left to coordinate c without overshooting;

moving right to coordinate Δ+c without overshooting;

moving left to coordinate 2c without overshooting;

alternately moving right and left until reaching:

moving right to coordinate Δ+(N−1)*c without overshooting;

moving left to coordinate N*c without overshooting;

moving right to coordinate Δ+N*c without overshooting;

moving left to coordinate N*c without overshooting;

moving right to coordinate Δ+(N−1)*c without overshooting;

alternately moving right and left until reaching:

moving left to coordinate 2c without overshooting;

moving right to coordinate Δ+c without overshooting;

moving left to coordinate c without overshooting;

moving right to coordinate Δ without overshooting;

moving left back to the origin without overshooting;

moving right to coordinate Δ+N*c without overshooting;

moving left back to the origin without overshooting;

Wherein, Δ≥a+b and is a finite value, a is the width of the paddle, b is the narrowest width of the gap between adjacent paddles, $$c = \begin{cases} a, & a < b \\ b, & a \geq b \end{cases}, b = N * a \text{ or } a = N * b,$$

N is a positive integer.

6. The electroplating apparatus according to claim 5, wherein a diffusion plate is provided between the paddles and the substrate, and the diffusion plate has multiple through-holes.

7. The electroplating apparatus according to claim 5, wherein the electroplating apparatus is provided with a guide rail, and the paddles are formed by opening strip-shaped through-holes on a paddle plate, one side of which is connected to a driving mechanism and the other side is slidably connected to the guide rail via an eccentric bearing.

8. The electroplating apparatus according to claim 7, wherein the driving mechanism, eccentric bearing, and guide rail are surrounded by a nitrogen protection box, and the nitrogen protection box is provided with a nitrogen inlet and a nitrogen outlet.

9. An electroplating apparatus, comprising: multiple parallel paddles, the paddles being arranged parallel to a substrate and moving to stir electroplating solution, wherein the electroplating apparatus further comprises a controller and a driving mechanism, the driving mechanism being connected to the controller and the paddles respectively, and the controller is programmed to control the driving mechanism to drive the paddles to move periodically so that each corresponding point on the substrate accumulated time blocked by the paddles is equal within a cycle;

taking the arrangement direction of the paddles as a coordinate axis direction, the movement steps of the paddles within the cycle comprising the following movement steps performed in succession:

moving right from an origin to coordinate Δ without overshooting;

moving left to coordinate c without overshooting;

moving right to coordinate Δ+c without overshooting;

moving left to coordinate 2c without overshooting;

alternately moving right and left until reaching:

moving right to coordinate Δ+ (y−2)*c without overshooting;

moving left to coordinate (y−1)*c without overshooting;

moving right to coordinate Δ+(y−1)*c without overshooting;

moving left back to the origin without overshooting;

wherein, Δ≥a+b and is a finite value, a is the width of the paddle, b is the narrowest width of the gap between adjacent paddles, $$c = \begin{cases} a, & a < b \\ b, & a \geq b \end{cases}, y = x * (N + 1), b = N * a \text{ or } a = N * b,$$

N is a non-integer greater than 1, and x is a positive integer that makes x*N be an integer.

10. An electroplating apparatus, comprising: multiple parallel paddles, the paddles being arranged parallel to a substrate and moving to stir electroplating solution, wherein the electroplating apparatus further comprises a controller and a driving mechanism, the driving mechanism being connected to the controller and the paddles respectively, and the controller is programmed to control the driving mechanism to drive the paddles to move periodically so that each corresponding point on the substrate accumulated time blocked by the paddles is equal within a cycle;

taking the arrangement direction of the paddles as a coordinate axis direction, the movement steps of the paddles within the cycle comprising the following movement steps performed in succession:

moving right from an origin to coordinate Δ without overshooting;

moving left to coordinate c without overshooting;

moving right to coordinate Δ+c without overshooting;

moving left to coordinate 2c without overshooting;

alternately moving right and left until reaching:

moving right to coordinate Δ+(y−2)*c without overshooting;

moving left to coordinate (y−1)*c without overshooting;

moving right to coordinate Δ+(y−1)*c without overshooting;

moving left to coordinate (y−1)*c without overshooting;

moving right to coordinate Δ+(y−2)*c without overshooting;

alternately moving right and left until reaching:

moving left to coordinate 2c without overshooting;

moving right to coordinate Δ+c without overshooting;

moving left to coordinate c without overshooting;

moving right to coordinate Δ without overshooting;

moving left back to the origin without overshooting;

moving right to coordinate Δ+(y−1)*c without overshooting;

moving left back to the origin without overshooting;

wherein, Δ≥a+b and is a finite value, a is the width of the paddle, b is the narrowest width of the gap between adjacent paddles, $$c = \begin{cases} a, & a < b \\ b, & a \geq b \end{cases}, y = x * (N + 1), b = N * a \text{ or } a = N * b,$$

N is a non-integer greater than 1, and x is a positive integer that makes x*N be an integer.

11. An electroplating method, comprising: setting multiple parallel paddles, the paddles being arranged parallel to a substrate and moving to stir electroplating solution, and controlling the paddles movement so that each corresponding point on the substrate accumulated time blocked by the paddles is equal within a cycle;

taking the arrangement direction of the paddles as a coordinate axis direction, the movement steps of the paddles within the cycle comprising the following movement steps performed in succession:

moving right from a coordinate origin to coordinate 4 without overshooting;

moving left to coordinate c without overshooting;

moving right to coordinate Δ+c without overshooting;

moving left to coordinate 2c without overshooting;

alternately moving right and left until reaching:

moving right to coordinate Δ+(N−1)*c without overshooting;

moving left to coordinate N*c without overshooting;

moving right to coordinate Δ+N*c without overshooting;

moving left back to the coordinate origin without overshooting;

wherein Δ≥a+b and is a finite value, a is the width of the paddle, b is the narrowest width of the gap between adjacent paddles, $$c = \begin{cases} a, & a < b \\ b, & a \geq b \end{cases}, b = N * a \text{ or } a = N * b,$$

and N is a positive integer.

12. An electroplating method, comprising: setting multiple parallel paddles, the paddles being arranged parallel to a substrate and moving to stir electroplating solution, and controlling the paddles movement so that each corresponding point on the substrate accumulated time blocked by the paddles is equal within a cycle;

taking the arrangement direction of the paddles as a coordinate axis direction, the movement steps of the paddles within the cycle comprising the following movement steps performed in succession:

moving right from an origin to coordinate Δ without overshooting;

moving left to coordinate c without overshooting;

moving right to coordinate Δ+c without overshooting;

moving left to coordinate 2c without overshooting;

alternately moving right and left until reaching:

moving right to coordinate Δ+(N−1)*c without overshooting;

moving left to coordinate N*c without overshooting;

moving right to coordinate Δ+N*c without overshooting;

moving left to coordinate N*c without overshooting;

moving right to coordinate Δ+(N−1)*c without overshooting;

alternately moving right and left until reaching:

moving left to coordinate 2c without overshooting;

moving right to coordinate Δ+c without overshooting;

moving left to coordinate c without overshooting;

moving right to coordinate Δ without overshooting;

moving left back to the origin without overshooting;

moving right to coordinate Δ+N*c without overshooting;

moving left back to the origin without overshooting;

Wherein, Δ≥a+b and is a finite value, a is the width of the paddle, b is the narrowest width of the gap between adjacent paddles, $$c = \begin{cases} a, & a < b \\ b, & a \geq b \end{cases}, b = N * a \text{ or } a = N * b,$$

N is a positive integer.

13. An electroplating method, comprising: setting multiple parallel paddles, the paddles being arranged parallel to a substrate and moving to stir electroplating solution, and controlling the paddles movement so that each corresponding point on the substrate accumulated time blocked by the paddles is equal within a cycle;

taking the arrangement direction of the paddles as a coordinate axis direction, the movement steps of the paddles within the cycle comprising the following movement steps performed in succession:

moving right from an origin to coordinate 4 without overshooting;

moving left to coordinate c without overshooting;

moving right to coordinate Δ+c without overshooting;

moving left to coordinate 2c without overshooting;

alternately moving right and left until reaching:

moving right to coordinate Δ+(y−2)*c without overshooting;

moving left to coordinate (y−1)*c without overshooting;

moving right to coordinate Δ+(y−1)*c without overshooting;

moving left back to the origin without overshooting;

wherein, Δ≥a+b and is a finite value, a is the width of the paddle, b is the narrowest width of the gap between adjacent paddles, $$c = \begin{cases} a, & a < b \\ b, & a \geq b \end{cases}, y = x * (N + 1), b = N * a \text{ or } a = N * b,$$

N is a non-integer greater than 1, and x is a positive integer that makes x*N be an integer.

14. An electroplating method, comprising: setting multiple parallel paddles, the paddles being arranged parallel to a substrate and moving to stir electroplating solution, and controlling the paddles movement so that each corresponding point on the substrate accumulated time blocked by the paddles is equal within a cycle;

taking the arrangement direction of the paddles as a coordinate axis direction, the movement steps of the paddles within the cycle comprising the following movement steps performed in succession:

moving right from an origin to coordinate 4 without overshooting;

moving left to coordinate c without overshooting;

moving right to coordinate Δ+c without overshooting;

moving left to coordinate 2c without overshooting;

alternately moving right and left until reaching:

moving right to coordinate Δ+(y−2)*c without overshooting;

moving left to coordinate (y−1)*c without overshooting;

moving right to coordinate Δ+(y−1)*c without overshooting;

moving left to coordinate (y−1)*c without overshooting;

moving right to coordinate Δ+(y−2)*c without overshooting;

alternately moving right and left until reaching:

moving left to coordinate 2c without overshooting;

moving right to coordinate Δ+c without overshooting;

moving left to coordinate c without overshooting;

moving right to coordinate Δ without overshooting;

moving left back to the origin without overshooting;

moving right to coordinate Δ+(y−1)*c without overshooting;

moving left back to the origin without overshooting;

wherein, Δ≥a+b and is a finite value, a is the width of the paddle, b is the narrowest width of the gap between adjacent paddles, $$c = \begin{cases} a, & a < b \\ b, & a \geq b \end{cases}, y = x * (N + 1), b = N * a \text{ or } a = N * b,$$

N is a non-integer greater than 1, and x is a positive integer that makes x*N be an integer.

* * * * *